US010835430B2

(12) United States Patent
Sweeney et al.

(10) Patent No.: US 10,835,430 B2
(45) Date of Patent: Nov. 17, 2020

(54) PATIENT MOBILITY SYSTEM WITH INTEGRATED AMBULATION DEVICE

(71) Applicant: Stryker Corporation, Kalamazoo, MI (US)

(72) Inventors: Christopher Ryan Sweeney, Portage, MI (US); Martin W. Stryker, Kalamazoo, MI (US); Joshua Elmer Mix, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 311 days.

(21) Appl. No.: 15/693,719

(22) Filed: Sep. 1, 2017

(65) Prior Publication Data

US 2018/0064591 A1 Mar. 8, 2018

Related U.S. Application Data

(60) Provisional application No. 62/382,879, filed on Sep. 2, 2016.

(51) Int. Cl.
*A61G 7/012* (2006.01)
*A61G 7/015* (2006.01)
(Continued)

(52) U.S. Cl.
CPC ..... *A61G 7/012* (2013.01); *A61G 5/00* (2013.01); *A61G 5/006* (2013.01); *A61G 7/005* (2013.01);
(Continued)

(58) Field of Classification Search
CPC ..... A61G 7/012; A61G 5/00; A61G 7/005; A61G 7/16; A61G 7/018; A61G 7/015;
(Continued)

(56) References Cited

U.S. PATENT DOCUMENTS 3,085,258 A 4/1963 Wolferts
3,790,974 A * 2/1974 Johansson ..... A61G 5/14 5/83.1
(Continued)

FOREIGN PATENT DOCUMENTS

AU 2010202928 A1 1/2011
CN 101077325 A 11/2007
(Continued)

OTHER PUBLICATIONS

English language abstract and machine-assisted English translation for KR 2013-0076922 extracted from espacenet.com database on Aug. 20, 2018, 8 pages.
(Continued)

*Primary Examiner* — Myles A Throop
(74) *Attorney, Agent, or Firm* — Howard & Howard Attorneys PLLC

(57) ABSTRACT

A patient mobility system for early patient ambulation. An ambulation device having a barrier is removably coupled to a patient support apparatus such that, in a coupled configuration, the barrier prevents patient egress from the patient support apparatus. The ambulation device configured to provide support to a patient during ambulation away from the patient support apparatus. Each of the patient support apparatus and the ambulation device can comprise a lift device operably controlled by a controller to maintain or control relative positioning of the patient support surface and the barrier in the coupled configuration. The lift device of the ambulatory device can comprise a gas spring having locking element. The ambulation device can comprise patient carrier removably coupled to a patient carrier mount. The patient carrier is configured to cooperate with the barrier to support the patient above a floor surface in a seated position.

20 Claims, 20 Drawing Sheets

(51) Int. Cl.

| | |
|---|---|
| ***A61G 7/018*** | (2006.01) |
| ***A61G 5/00*** | (2006.01) |
| ***A61G 7/16*** | (2006.01) |
| ***A61G 7/10*** | (2006.01) |
| ***A61H 3/04*** | (2006.01) |
| ***A61G 7/05*** | (2006.01) |
| ***A61G 7/005*** | (2006.01) |

(52) U.S. Cl.
CPC ..... *A61G 7/015* (2013.01); *A61G 7/018* (2013.01); *A61G 7/0509* (2016.11); *A61G 7/0514* (2016.11); *A61G 7/1019* (2013.01); *A61G 7/16* (2013.01); *A61H 3/04* (2013.01); *A61G 2203/40* (2013.01); *A61G 2203/80* (2013.01); *A61H 2003/043* (2013.01); *A61H 2201/0107* (2013.01); *A61H 2201/0138* (2013.01); *A61H 2201/0142* (2013.01); *A61H 2201/0149* (2013.01); *A61H 2201/0157* (2013.01); *A61H 2201/0161* (2013.01); *A61H 2201/0192* (2013.01); *A61H 2201/1207* (2013.01); *A61H 2201/1633* (2013.01); *A61H 2201/1635* (2013.01); *A61H 2203/0406* (2013.01); *A61H 2203/0431* (2013.01)

(58) Field of Classification Search
CPC .... A61G 7/0509; A61G 7/1019; A61G 5/006; A61G 7/0514; A61G 2203/80; A61G 2203/40; A61H 3/04; A61H 2003/043; A61H 2203/0431; A61H 2203/0406; A61H 2201/1635; A61H 2201/1633; A61H 2201/1207; A61H 2201/0192; A61H 2201/0161; A61H 2201/0157; A61H 2201/0149; A61H 2201/0142; A61H 2201/0138; A61H 2201/0107
See application file for complete search history.

(56) References Cited

U.S. PATENT DOCUMENTS 4,010,499 A * 3/1977 Davis ..... A61G 7/10 5/87.1
4,724,555 A 2/1988 Poehner et al.
4,805,249 A 2/1989 Usman et al.
4,819,283 A 4/1989 DiMatteo et al.
4,890,853 A * 1/1990 Olson ..... A61G 5/00 280/47.4
4,987,620 A 1/1991 Sharon
5,103,511 A 4/1992 Sequin
5,134,737 A 8/1992 Wyman
5,230,113 A 7/1993 Foster et al.
5,257,426 A 11/1993 Leoutsakos
5,299,334 A 4/1994 Gonzalez
5,398,357 A 3/1995 Foster
5,513,406 A 5/1996 Foster et al.
5,555,582 A 9/1996 Jerideau
5,611,638 A * 3/1997 Dorr ..... A61G 7/1019 403/321
5,613,252 A 3/1997 Yu et al.
5,680,661 A 10/1997 Foster et al.
5,715,548 A 2/1998 Weismiller et al.
6,374,436 B1 4/2002 Foster et al.
6,397,416 B2 6/2002 Brooke et al.
6,499,159 B1 * 12/2002 Schmitt ..... A61B 6/04 192/84.9
6,640,360 B2 11/2003 Hornbach et al.
6,694,548 B2 2/2004 Foster et al.
6,725,474 B2 4/2004 Foster et al.
6,851,142 B2 2/2005 Stryker et al.
7,526,823 B2 * 5/2009 Koch ..... A61G 13/00 5/600
7,636,966 B2 12/2009 Gallant et al.
7,716,762 B2 5/2010 Ferraresi et al.
7,761,942 B2 7/2010 Benzo et al.
7,788,748 B2 * 9/2010 Wurdeman ..... A61G 7/00 5/600
7,886,379 B2 2/2011 Benzo et al.
8,336,133 B2 12/2012 Palay et al.
8,474,076 B2 7/2013 Hornbach
8,567,808 B2 * 10/2013 Tholkes ..... A61G 5/1094 280/47.4
8,578,531 B2 11/2013 Abernathey et al.
8,677,524 B2 3/2014 Kume et al.
8,793,824 B2 8/2014 Poulos et al.
8,844,075 B2 9/2014 Heimbrock
8,864,205 B2 10/2014 Lemire et al.
8,959,681 B2 2/2015 Richards
8,973,187 B2 3/2015 Hornbach
9,078,628 B2 * 7/2015 Cumpson ..... A61B 5/0555
9,138,173 B2 9/2015 Penninger et al.
9,306,322 B2 4/2016 Bhimavarapu et al.
9,940,810 B2 4/2018 Derenne et al.
2003/0052787 A1 3/2003 Zerhusen et al.
2003/0112147 A1 * 6/2003 George ..... A47B 9/20 340/691.6
2004/0064886 A1 * 4/2004 Alverson ..... A61G 5/00 5/83.1
2004/0133979 A1 7/2004 Newkirk et al.
2004/0177445 A1 9/2004 Osborne et al.
2006/0085914 A1 4/2006 Peterson et al.
2006/0130239 A1 6/2006 Smith
2010/0017964 A1 1/2010 Kruse
2010/0064439 A1 3/2010 Soltani
2010/0212087 A1 8/2010 Leib et al.
2010/0287698 A1 * 11/2010 Stryker ..... A61G 5/1059 5/87.1
2011/0162142 A1 7/2011 Hakamiun et al.
2012/0117732 A1 5/2012 O'Keefe
2012/0124745 A1 5/2012 Heimbrock et al.
2012/0137439 A1 6/2012 Heimbrock
2012/0169093 A1 7/2012 Kume et al.
2012/0198626 A1 8/2012 Richards
2012/0198628 A1 8/2012 Richards
2012/0297544 A1 11/2012 Griswold et al.
2013/0212807 A1 8/2013 Manson et al.
2013/0227787 A1 9/2013 Herbst et al.
2015/0115628 A1 4/2015 Wittelsbuerger et al.
2015/0115638 A1 4/2015 Lambarth et al.
2015/0164722 A1 6/2015 Roussy et al.
2015/0272518 A1 * 10/2015 Koerth ..... A61B 6/0407 5/601
2016/0013837 A1 1/2016 Howell et al.
2016/0022039 A1 1/2016 Paul et al.
2016/0089283 A1 3/2016 DeLuca et al.
2016/0193095 A1 7/2016 Roussy et al.
2016/0302985 A1 10/2016 Tessmer et al.
2017/0056267 A1 3/2017 Stryker et al.
2017/0079434 A1 3/2017 Paul et al.
2017/0172829 A1 6/2017 Tessmer et al.
2018/0000670 A1 1/2018 Bartley et al.
2018/0000672 A1 1/2018 Heneveld, Jr. et al.
2018/0000673 A1 1/2018 Bartley
2018/0000674 A1 1/2018 Bartley
2018/0000675 A1 1/2018 Heneveld, Jr. et al.
2018/0064589 A1 3/2018 Larsen et al.
2018/0064592 A1 3/2018 Sweeney et al.
2018/0190100 A1 7/2018 Derenne et al.
2019/0015279 A1 * 1/2019 Tessmer ..... A61G 7/0518

FOREIGN PATENT DOCUMENTS

DE 4039253 A1 6/1992
EP 262771 A1 4/1988
EP 932385 B1 3/2004
EP 2481388 A1 8/2012
EP 2484326 A2 8/2012
EP 2481388 B1 11/2015
GB 905708 A 9/1962
JP 2014188340 A 10/2014
KR 20130076922 A 7/2013

(56) References Cited

FOREIGN PATENT DOCUMENTS

| | | | |
|---|---|---|---|
| WO | 2007055051 | A1 | 5/2007 |
| WO | 2015126742 | A1 | 8/2015 |
| WO | 2016171746 | A1 | 10/2016 |

OTHER PUBLICATIONS

L.L. Bean Inc., "Camp Comfort Recliner", URL: https://www.llbean.com/llb/shop/111730?page=llbean-camp-comfort-recliner.
Positive Posture LLC, "Luma Designer Recliner", URL: https://www.positiveposture.com/products/recliners/luma/.
Hill-Rom Services, Inc., "Progressa(TM) Bed System, Technical Specifications", 2013; 4 pages.
Hill-Rom Services, Inc., "Progressa(TM) Bed System, Advancing mobility. Accelerating Recovery." 2013; 16 pages.
English language abstract and machine-assisted translation for DE4039253 extracted from espacenet.com on Mar. 27, 2018; 5 pages.
English language abstract and machine-assisted translation for CN101077325 extracted from espacenet.com on Mar. 27, 2018; 4 pages.
English language abstract for JP5432400 extracted from espacenet.com on Mar. 27, 2018; 1 page.
English language abstract for WO2007055051 extracted from espacenet.com on Mar. 27, 2018; 1 page.

* cited by examiner

PATIENT MOBILITY SYSTEM WITH INTEGRATED AMBULATION DEVICE

CROSS REFERENCE TO RELATED APPLICATION

This application claims the benefit of U.S. Provisional Patent Application No. 62/382,879, filed on Sep. 2, 2016, which is hereby incorporated by reference in its entirety.

BACKGROUND

Patient support apparatuses, such as hospital beds, stretchers, cots, tables, and wheelchairs, facilitate care of patients in a health care setting. Most patients require only temporary use of a patient support apparatus during the initial stages of their illness or injury. Health care providers generally promote early patient mobility to advance patient recovery.

To that end, ambulation devices, such as walkers, crutches, and canes, provide ambulatory support to patients who are not full weight bearing or otherwise unable to ambulate without assistance. Often, the ambulation device is positioned next to the patient support apparatus, after which the patient is effectively transferred from the latter to the former. For example, a patient transfer might comprise rising from a sitting position on the patient support apparatus to a standing position at least partially supported by the ambulation device.

Accidents associated with patient transfers are a common source of injuries. A caregiver is often unsure of the patient's weight bearing capacity and/or unable to physically support the patient in the unfortunate event of a sudden fall. In fact, caregivers likewise often suffer physical injuries during patient transfers. Further, the fear of being held responsible for a patient falling under one's care often makes the caregivers hesitant to promote early patient mobility, thereby delaying the ultimate recovery of the patient.

Promoting early patient mobility is an area of much interest and development. Conventional patient support apparatuses may be positionable in different configurations such as a bed configuration, a chair configuration, and several configurations therebetween. In the chair configuration, a patient is more likely to successfully rise to a standing position during a patient transfer. In the chair configuration, however, the footboard prevents the patient from achieving a firm footing on the ground, thereby adding uncertainty to the patient transfer. Furthermore, storage of the footboard may be impractical due to space limitations in the hospital room.

Therefore, a need exists in the art for a patient mobility system designed to overcome one or more of the aforementioned disadvantages.

BRIEF DESCRIPTION OF THE DRAWINGS

The disclosure will be further described in the following description of the particular embodiments in connection with the drawings.

DETAILED DESCRIPTION

Figure 1A:
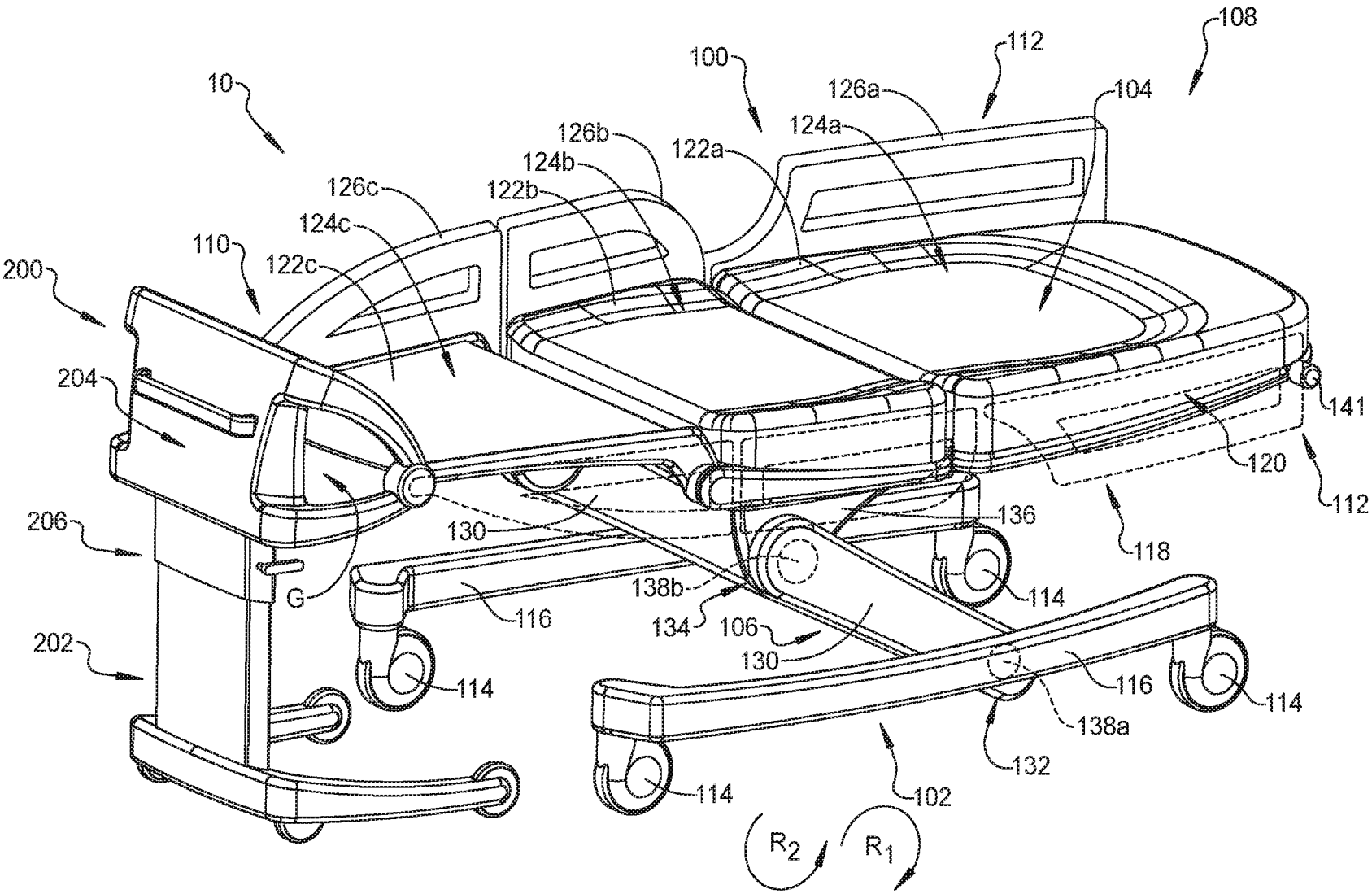
FIG. 1A is a perspective view of a patent mobility system in accordance with an exemplary embodiment of the present disclosure, with an ambulation device shown coupled to a patient support apparatus.
Figure 1B:
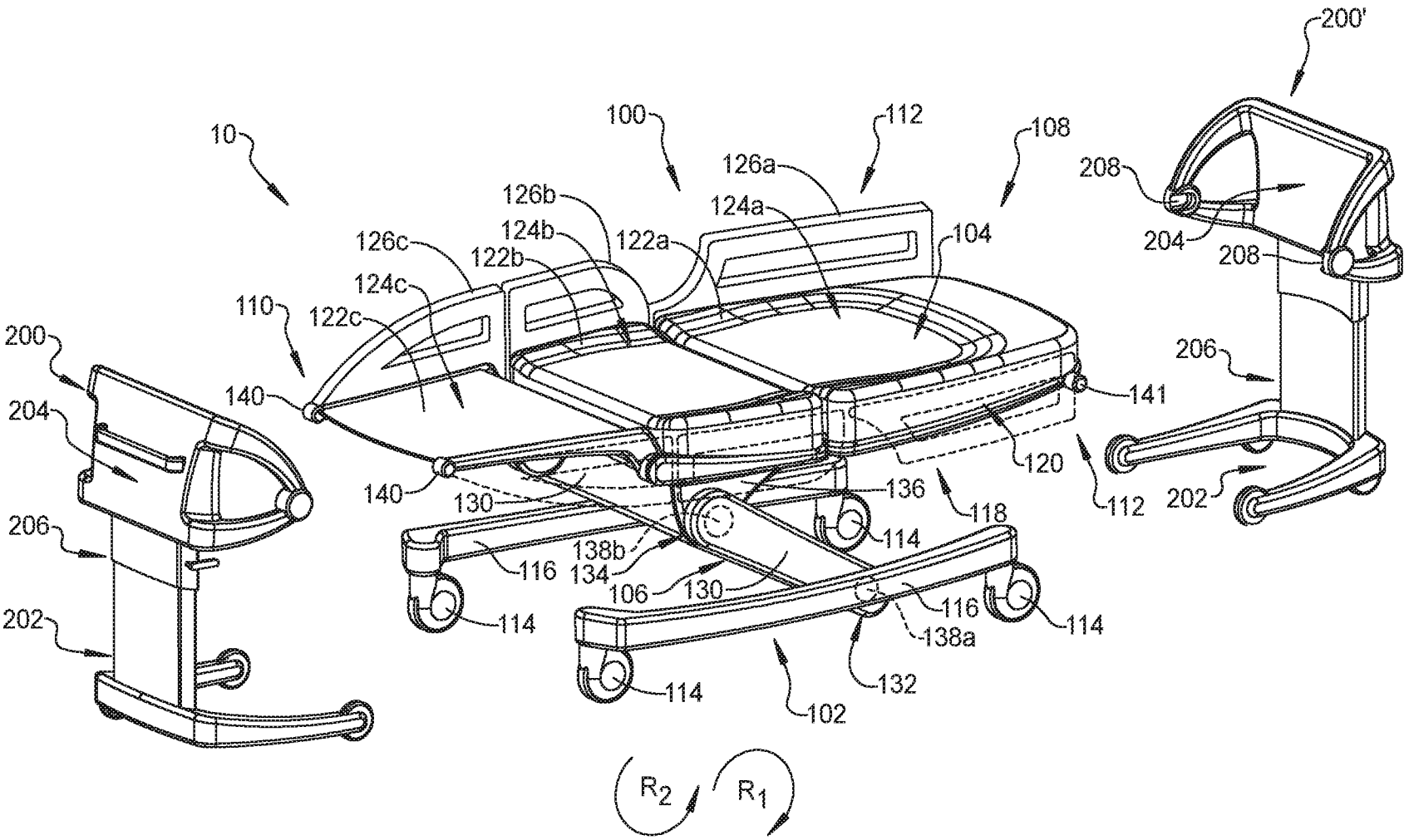
FIG. 1B is a perspective view of the patent mobility system, with the ambulation device of FIG. 1A positioned at a foot end of the patient support apparatus and a second ambulation device is shown and positioned at the head end of patient support apparatus, with the first and second ambulation devices being shown uncoupled.

FIGS. 1A and 1B illustrate a patent mobility system 10 in accordance with an exemplary embodiment of the present disclosure. The patient mobility system 10 comprises a patient support apparatus 100 and an ambulation device 200. The patient support apparatus 100 moves a patient from one location to another. The patient support apparatus 100 illustrated in the figures is a hospital bed, but alternatively can be a stretcher, cot, or similar support apparatus without deviating from the objects of the present disclosure.

The ambulation device 200 is configured to provide support to the patient during ambulation away from the patient support apparatus 100. The ambulation device illustrated in the figures is a walker, but alternatively can be a rollator, a stroller, a hybrid walker, transport chair, or similar transport apparatus without deviating from the objects of the present disclosure.

The patient support apparatus 100 comprises a base 102, a patient support surface 104, and a first lift device 106. The patient support apparatus 100 further comprises a head end 108 and a foot end 110 separated by opposing sides 112. The base 102 is configured to rest upon the floor surface and support and stabilize patient support apparatus 100. The base 102 can comprise a pair of elongated legs 116 oriented parallel to the floor surface. Each of the elongated legs 116 can be generally positioned beneath one of the opposing sides 112. The elongated legs 116 can be of any suitable length to provide adequate longitudinal and transverse stability to the patient support apparatus 100. The construction of the base 102 may take on any known or conventional design, and is not limited to that specifically set forth above.

The base 102 comprises wheels 114 configured to facilitate transport over a floor surface 12. The wheels 114 preferably are casters configured to rotate and swivel relative to the base 102 during transport. In some embodiments, the wheels 114 may be non-steerable, steerable, non-powered, powered, or combinations thereof. Additional wheels are also contemplated. For example, the patient support apparatus 100 may comprise four non-powered, non-steerable wheels, along with one or more powered wheels. The present disclosure also contemplates that the patient support apparatus 100 may not comprise wheels. In the exemplary embodiments illustrated in FIGS. 1A and 1B, each of the four wheels 114 is disposed proximate to an end of one of the elongated legs 116 of the base 102.

The patient support surface 104 is supported by the base 102. More specifically, an intermediate frame 118 is spaced above the base 102, and a patient support deck 120 is disposed on the intermediate frame 118. As commonly understood in the art, a mattress 122 is disposed on the patient support deck 120 and comprises the patient support surface 104. Any suitable component of the patient support apparatus 100 can comprise at least a portion of the patient support surface 104 to support to the patient, either directly or indirectly. For example, the intermediate frame 118 can comprise the patient support surface 104. For another example, the patient support deck 120 can comprise the patient support surface 104 with or without the mattress 122 disposed on the patient support deck 120. Additionally or alternatively, a separate, modular mattress pad adapted to be placed upon the mattress 122 and comprise the patient support surface 104. Those having ordinary skill in the art will appreciate that support of the patient could be effected in a number of different ways without deviating from the objects of the present disclosure.

The patient support apparatus 100, particularly the patient support deck 120, can comprise articulating sections 124 configured to articulate the patient support surface 104 between various configurations, which will be disclosed in further detail herein. The articulating sections 124 can comprise a head section 124*a*, a seat section 124*b*, and a foot section 124*c*. The head section 124*a* is proximate the head end 108, the foot section 124*c* proximate the foot end 110. The seat section 124*b* is between the head section 124*a* and the foot section 124*c*. Likewise, the mattresses 122 comprises mattress sections 122*a*, 122*b*, 122*c* each associated with one of the articulating sections 124. While three articulating sections 124 are illustrated in in the figures, the present disclosure contemplates any number and/or type of articulating sections may be incorporated, including but not limited to a back section, a leg section, and the like. In other exemplary embodiments, the patient support deck 120 can comprise a rigid patient support deck unable to articulate.

The patient support apparatus 100 can further comprise side rails 126 coupled to the intermediate frame 118. In the exemplary embodiment, each of three side rails 126*a*, 126*b*, 126*c* is associated with one of the articulating sections 124. Any number of side rails 126 can be included without deviating from the objects of the present disclosure. For example, if the patient transport apparatus 100 is a stretcher or cot, fewer side rails may be present. The side rails 126 are movable between a raised position in which they obstruct ingress into and egress out of the patient transport apparatus 100, a lowered position with no such obstruction (illustrated in phantom in FIGS. 1A and 1B), and any number of intermediate positions therebetween. In other exemplary embodiments, the patient transport apparatus 100 may not comprise any side rails.

The first lift device 106 is operably coupled to the patient support surface 104 and the base 102, and moves the patient support surface 104 relative to the base 102. In the illustrated embodiment, the first lift device 106 comprises a lifting arm 130 having a first end 132 pivotally coupled to one of the elongated legs 116 of the base 102, and a second end 134 pivotally coupled to a lift bracket 136. The lift bracket 136 is coupled to the intermediate frame 118, and more specifically an underside of the intermediate frame 118 associated with the seat section 124*b*.

The first lift device 106 can further comprise one or more actuators 138. The actuators 138 are configured to impart relative motion between coupled structures of the first lift device 106. For example, the illustrated embodiment comprises a first actuator 138*a* pivots the lifting arm 130 relative to the elongated leg 116 of the base 102 (a counterpart configuration is disposed on the opposing elongated leg 116). Upon actuation, the first actuator 138*a* pivots the lifting arm 130 in a first radial direction R1 to raise (and tilt) the patient support surface 104 relative to the base 102, or pivots the lifting arm 130 in a second radial direction R2 to lower (and tilt) the patient support surface 104 relative to the base 102.

Raising or lowering the patient support surface 104 via actuation of the first actuator 138*a*, absent any additional action by the first lift device 106, can orient the patient support surface 104 on an incline or decline. Therefore, a second actuator 138*b* pivotally couples the second end 134 of the lifting arm 130 and the lift bracket 136. The second actuator 138*b* is configured to pivot the lift bracket 136 relative to the lifting arm 130. If desired, concurrent actuation of the first actuator 138*a* and the second actuator 138*b* can maintain a generally horizontal orientation of the patient support surface 104. More specifically, when the first actuator 138*a* pivots lifting arm 130 in the first radial direction R1, and the second actuator 138*b* pivots the lift bracket 136 in the second radial direction R2 by a substantially equal angular displacement. If desired, the first actuator 138*a* and the second actuator 138*b* can impart different magnitudes of angular displacement to orient the patient support surface 104 to a tilted position (see FIG. 9B).

In one exemplary embodiment of the present disclosure, the first actuator 138*a* and/or the second actuator 138*b* can comprise an electric motor that receives an electric input and outputs rotational motion. Any suitable gearing can be incorporated to produce the desired speed and torque properties of the electric motor. Alternatively or additionally, an electromechanical actuator, hydraulic piston, pneumatic piston, or other suitable actuator can be included in the first lift device 106 without deviating from the objects of the present disclosure.

FIG. 1A shows a lifting arm 130 associated with each elongated leg 116 of the base 102 and generally positioned beneath the opposing sides 112 of the patient support surface 104. Consequently, the lift device of the patient support apparatus 100 requires fewer structures in a space between the lifting arms 130 and beneath the intermediate frame 116. Thus, among other advantages, the lift device 104 of the patient support apparatus 100 provides considerable clearance to permit up to 180° articulation of the foot section 124*c* relative to the seat section 124*b*, as will be disclosed in detail herein.

Figure 2:
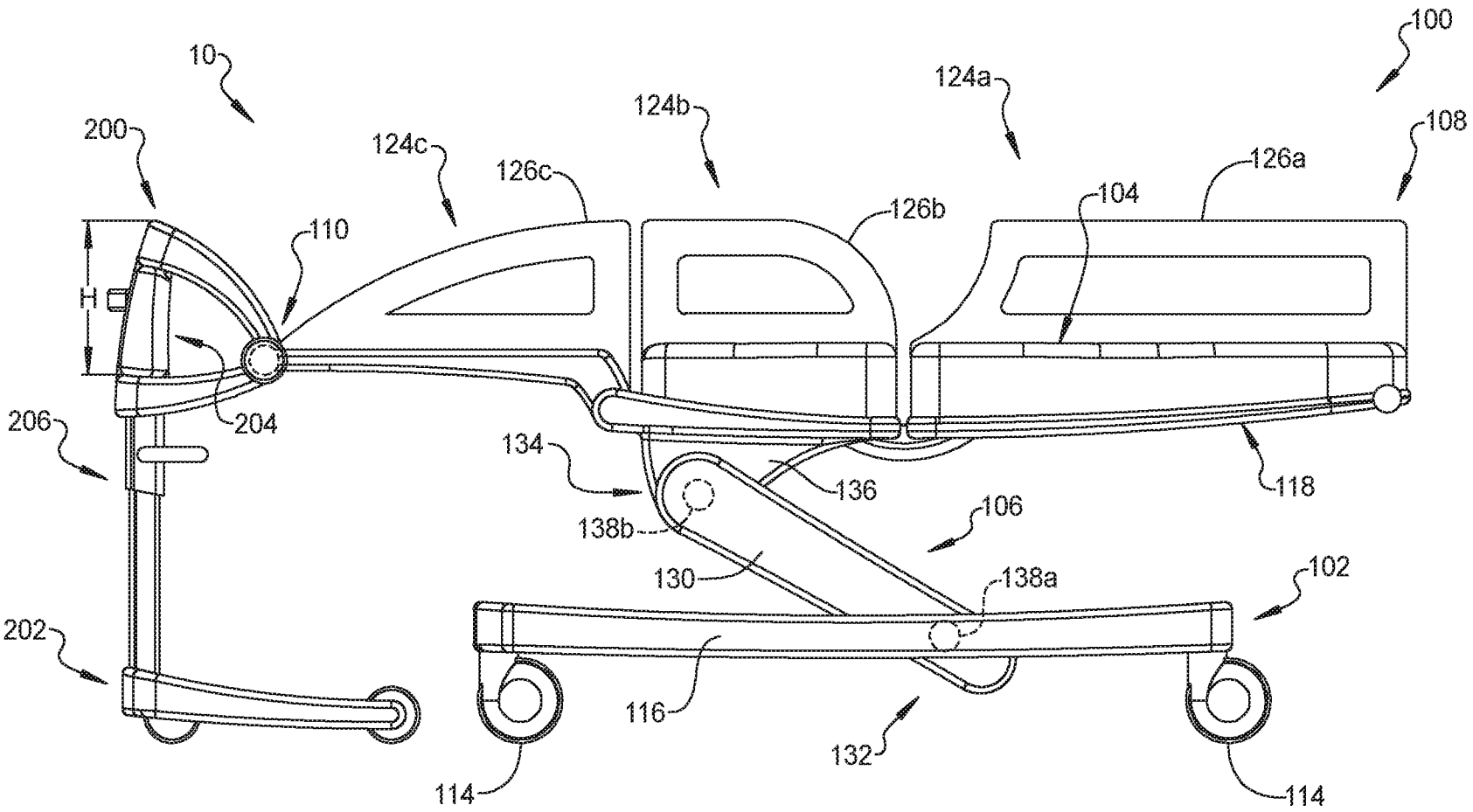
FIG. 2 is a side elevation view of the patent mobility system of FIG. 1A, with the ambulation device shown coupled to the patient support apparatus.

In the exemplary embodiment illustrated in FIGS. 1A and 2, the ambulation device 200 is positioned proximate and coupled to the patient support apparatus 100 at the foot end 110. A headboard (not shown) can be coupled to the patient support apparatus 100 at the head end 108. In particular, the headboard can be removably coupled to or integrally formed with the intermediate frame 118 and at least partially extend above the patient support surface 104 of the patient support apparatus 100 at the head end 108. A headboard coupled to a patient support apparatus is well known to those having skill in the art.

Referring to FIG. 1B, in certain aspects of the present disclosure, a second ambulation device 200' can be positioned proximate and coupled to the patient support apparatus 100 at the head end 108. In such aspects, ambulation devices 200, 200' are positioned proximate to the patient support apparatus 100 at the head end 108 and the foot end 110. The second ambulation device 200' is configured to be removably coupled to the patient support apparatus 100. To that end, a coupling member 141 can be coupled to the patient support apparatus 100 at the head end 108 and configured to removably couple to a second coupling member 208 associated with the second ambulation device 200'. Consistent with the primary objects of the present disclosure discussed below, in the coupled configuration, the second ambulation device 200' prevents patient egress by being adjacent to the head end 108 of the patient support surface 104 and by having a height sufficient to at least partially extend above the patient support surface 104 of the patient support apparatus 100. The present disclosure also contemplates one or more ambulation devices can be positioned adjacent one or both of the opposing sides 112 to prevent patient egress from the opposing sides 112 by having a height sufficient to at least partially extend above the patient support surface 104 of the patient support apparatus 100. Any number of ambulation devices can be incorporated into the patient mobility system 10 without deviating from the objects of the present disclosure. Additionally or alternatively, the ambulation device 200, the second ambulation device 200', and/or additional ambulation devices can be coupled to the patient support apparatus 100 at one or both of the opposing sides 112. The ambulation device(s) can be positioned at any one or more of the articulating sections 124*a*, 124*b*, 124*c*. In such an arrangement, the articulating sections 124*a*, 124*b*, 124*c* can include coupling members as disclosed below. In one example, eight ambulation devices 200 effectively surround the patient support apparatus 100: one at the head end 108, one at the foot end 110, and one at each articulating section 124*a*, 124*b*, 124*c* on each of the opposing sides 112. In such an arrangement, the headboard, footboard, and side rails are comprised of barriers of the ambulation devices consistent with the objects of the present disclosure described below.

Figure 3A:
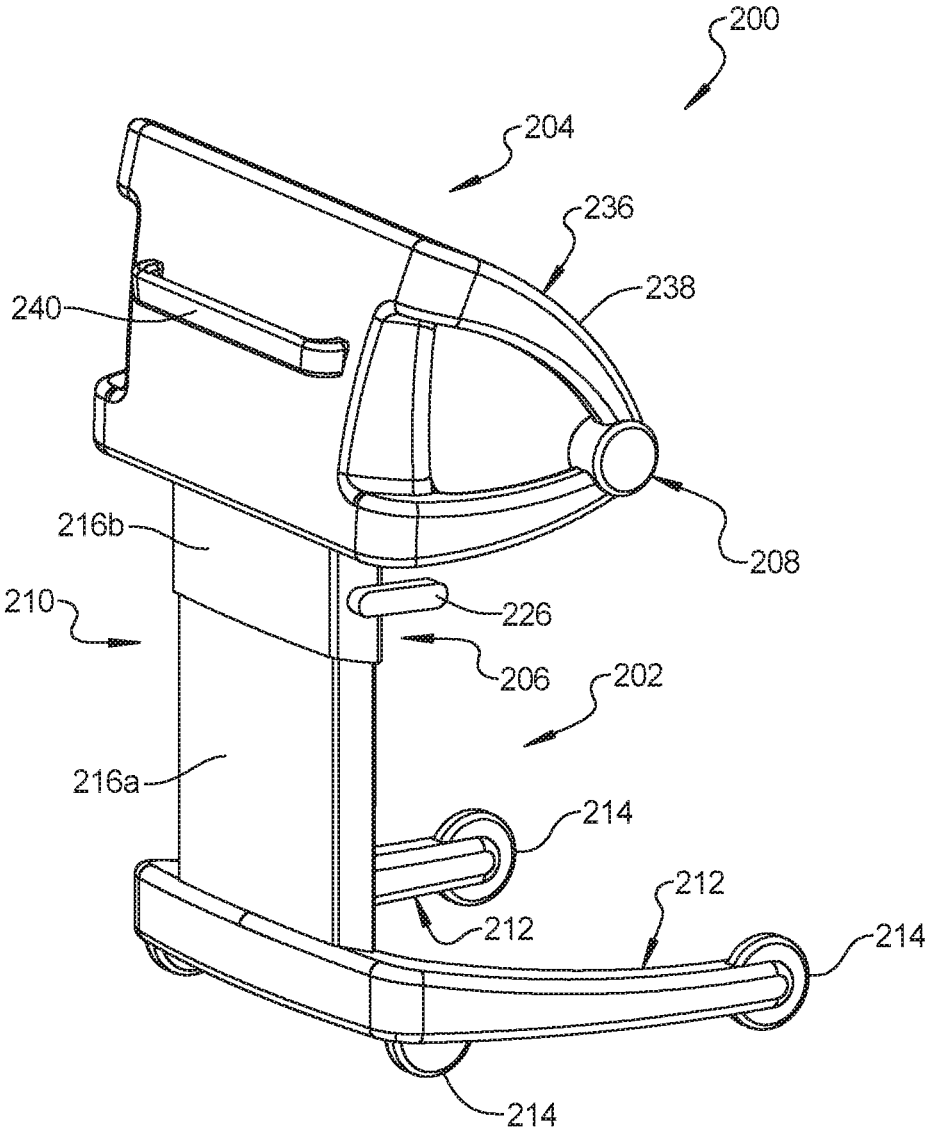
FIG. 3A is a perspective view of the ambulation device of FIG. 1A.

Referring to FIG. 3A, an ambulation device 200 in accordance with an exemplary embodiment is illustrated. The ambulation device 200 comprises a support frame 202, a barrier 204, and a second lift device 206. The barrier 204 is coupled to the support frame 202, and the second lift device 206 is configured to move the barrier 204 relative to the support frame 202.

A grip 236 can provide support to the patient during ambulation. More specifically, the grip 236 is configured to be grasped by the hand(s) of the patient. Thus, the grip 236 can be of any suitable size, shape, and material to provide a comfortable, graspable structure for the patient.

Figure 3B:
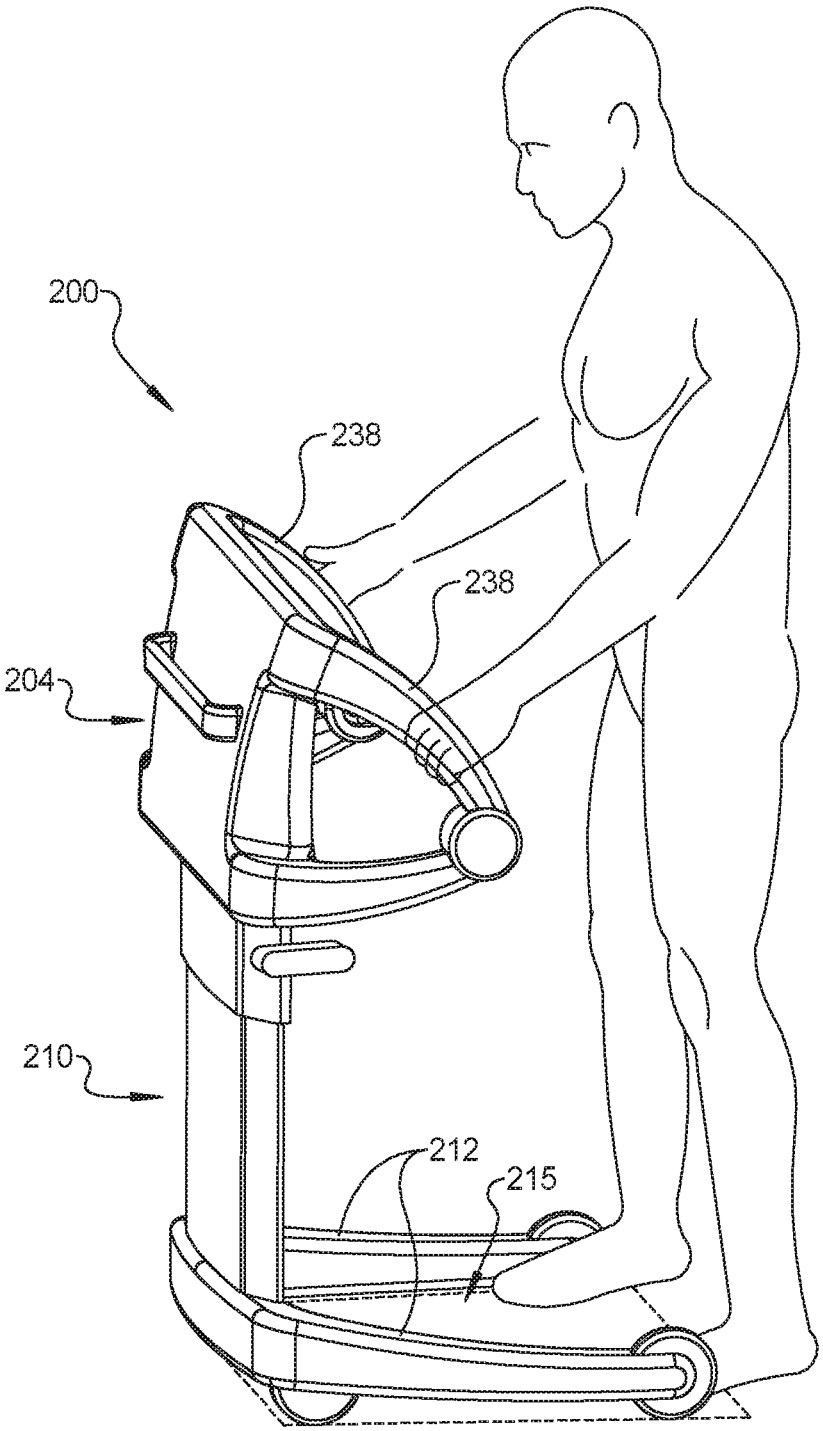
FIG. 3B is a perspective view of the ambulation device of FIG. 1A supporting a patient during ambulation away from the patient support apparatus.

In at least some aspects of the present disclosure, the ambulation device 200 further comprises handles 238. Each handle 238 is coupled to the barrier 204 and can define the grip 236. In the exemplary embodiment illustrated in FIGS. 3A and 3B, the handles 238 are disposed on opposing sides of the barrier 204. While the exemplary embodiment comprises two handles 238, the present disclosure contemplates one, three, four or more handles. The handles 238 can extend away from the barrier 204, as illustrated in FIGS. 3A and 3B, or comprise an elongated member oriented substantially parallel to the barrier 204 (similar to accessory support 240 but disposed on opposite side of barrier 204). Additionally or alternatively, the grip 236 comprises an upper edge or other suitable portion of the barrier 204. The grip 236 can be integral with the barrier 204, or coupled to the barrier 204 through means commonly know in the art.

In another exemplary embodiment, the ambulation device 200 comprises a barrier device. The barrier device comprises the support frame 202 and the barrier 204 coupled to the support frame 202. The barrier device is configured to be removably coupled to the patient support apparatus 100. In a coupled configuration, the barrier 204 prevents patient egress from the patient support apparatus 100 by being positioned adjacent to the patient support surface 104 and by having a height sufficient to at least partially extend above the patient support surface 104. The barrier device can further comprise the second lift device 206 to move said barrier 204 relative to said support frame 202.

The ambulation device 200 can further comprise the accessory support 240. The accessory support 240 can be coupled to the barrier 204, as illustrated in FIGS. 3A and 3B. Alternatively, the accessory support 240 may be coupled to the second lift device 206, to the support frame 202, and/or any other suitable structure. The accessory support 240 can comprise one or more hooks, clips, rings, poles, rods, or any suitable structure for supporting a medical accessory. The accessory support 240 is configured to removably couple to medical equipment and supplies, personal articles, and the like.

The support frame 202 of the ambulation device 200 may comprise a back 210 and feet 212 extending away from the back 210. The feet 212 can be elongated members generally oriented parallel to the floor surface 12 to support and stabilize the ambulation device 200. The feet 212 are positioned such that the center of mass of the ambulation device 200 (along with the weight of the patient support by the ambulation device 200) is above the feet 212 to ensure stability of the ambulation device 200. In a preferred embodiment, and with concurrent reference to FIG. 3B, the feet 212 extend away from the back 210 in a direction such that the back 210 and the feet 212 define a patient walking area 215 therebetween. More specifically, the patient walking area 215 is defined by a downward projection of the back 210 and the feet 212 of the ambulation device 200, as illustrated in FIG. 3B. The patient walking area 215 generally encompasses the widest dimension of the ambulation device 200 to form a generally rectangular shape. In other words, the patient walking area 215 is the rectangular projection of the greatest length and width dimension of the back 210 and the feet 212, collectively. In a more general sense, the patient walking area 215 is an area of the floor surface 12 that a patient typically occupies while ambulating while supported by the ambulation device 200. The handles 238 can extend away from the barrier 204 and generally positioned above the feet 212 of the support frame 202. Additionally or alternatively, the downward projection of the handles 238 can further define the patient walking area 215 therebetween.

The support frame 202 may further comprise wheels 214 coupled to the feet 212. The wheels 214 are configured to facilitate transport of the ambulation device 200 over the floor surface 12. The wheels 214 can be casters configured to rotate and swivel relative to the support frame 202 during transport, and/or non-steerable, steerable, non-powered, and/or powered wheels. In the exemplary embodiment illustrated in FIGS. 3A and 3B, each of the four wheels 214 is disposed proximate to an end of one of the feet 212 of the support frame 202. The wheels 214 permit eased movement of the ambulation device 200 whether or not the ambulation device 200 is coupled to the patient support apparatus 100.

The back 210 of the support frame 202 may further comprise sections configured to be movable relative to one another. Referring to FIG. 3A, the back 210 comprises a first section 216*a* rigidly coupled to the feet 212 and a second section 216*b* rigidly coupled to the barrier 204. The first section 216*a* is slidable relative to the second section 216*b* in a generally telescoping manner when the elevation of the barrier 204 relative to the support frame 202 is adjusted.

The ambulation device 200 is configured to removably couple to the patient support apparatus 100. The coupling of the ambulation device 200 and the patient support apparatus 100 defines the coupled configuration.

In the coupled configuration, the barrier 204 of the ambulation device 200 is positioned adjacent to the patient support surface 104 of the patient support apparatus 100. The positioning of the ambulation device 200 adjacent to the patient support surface 104 is configured to minimize any gap G between the foot end 110 of the patient support apparatus 100 and the barrier 204 of the ambulation device 200, as illustrated in FIG. 1A. The gap G is sufficiently small so as to prevent any patient feature (e.g., leg, arm, head), and especially the patient, from passing through or otherwise becoming lodged within the gap G. In one embodiment, the gap G may be less than 15, 12, 9, 6, or 3 cm. However, the size of the gap G is not particularly limited. Furthermore, in the coupled configuration, the barrier 204 of the ambulation device 200 has a height H sufficient to at least partially extend above the patient support surface of the patient support apparatus 100 so as to prevent patient egress, as illustrated in FIG. 2. For example, the barrier 204 may extend above the patient support surface by at least 5, 10, 15, 20, 25, or 30 cm.

When not in the coupled configuration, however, the ambulation device provides support to the patient ambulation away from the patient support apparatus, as illustrated in FIG. 3B. Thus, in both the coupled configuration and an uncoupled configuration, the ambulation device 200 advantageously is a functional component of the patient mobility system 10.

To couple the patient support apparatus 100 and the ambulation device 200, each of the patient support apparatus 100 and the ambulation device 200 may comprise one or more coupling members. The patient support apparatus 100 comprises a first coupling member 140 coupled to the patient support surface 104, as best shown in FIG. 1B. More specifically, the first coupling member 140 can be coupled to the patient support surface 104 via the intermediate frame 118 associated with the articulating section 124*c* proximate the foot end 110. While FIG. 1B shows the first coupling member 140 positioned at an end of the articulating section 124*c*, the first coupling member 140 can be positioned anywhere along the articulating section 124*c*. In one example, the first coupling member 140 is disposed between the two ends o the articulating section 124*c*, such as at a midpoint. In such an example, the gap G is between the foot end 110 of the patient support apparatus 100 and the barrier 204 of the ambulation device 200 can be reduced to a desired distance. The present disclosure also contemplates the first coupling member 140 can be coupled to one of the base 102 and the first lift device 106, or any other suitable position to allow coupling to the second coupling member.

The ambulation device 200 comprises second coupling member 208 coupled to each of the handles 238 comprising the grip 236. Among other advantages, positioning the second coupling member 208 at an end of each of the handles 238 can minimize the gap G between the barrier 204 of the ambulation device 200 and the patient support apparatus 100 in the coupled configuration, as previously discussed herein. The present disclosure also contemplates the second coupling member 208 can additionally or alternatively be coupled to one of the support frame 202, the barrier 204, and the second lift device 206, or any other suitable location to enable the second coupling member to couple to the first coupling member.

The coupled configuration may be further defined by engagement of the first coupling member 140 and the second coupling member 208. When the first coupling member 140 is coupled to the second coupling member 208, movement of the ambulation device 200 is generally constrained to movement of the patient support apparatus 100. In other words, the patient support apparatus 100 is fixed relative to the ambulation device 200 to prevent relative horizontal movement therebetween. Conversely, relative horizontal movement between the patient support apparatus 100 and the ambulation device 200 is not constrained when the patient support apparatus 100 is not coupled to the ambulation device 200. It is understood that with the patient support apparatus 100 is fixed relative to the ambulation device 200 to prevent relative horizontal movement, certain operations may be performed that alter the horizontal position of one of the patient support apparatus 100 and the ambulation device 200 along the floor surface. For example, the patient support apparatus 100 may perform a bed extension operation including moving the foot end 110 away from the head end 108 to lengthen the patient support surface 104. With the ambulation device 200 coupled to, for example, the foot end 110, the horizontal position of the ambulation device 200 along the floor surface is altered, and the ambulation device 200 may be considered to move horizontally relative to the head end 108 of the patient support apparatus 100. Yet the ambulation device 200 is constrained from horizontal movement relative to the foot end 110 at which the ambulation device 200 is coupled. Thus, in certain embodiments, it is understood that the preventing relative horizontal movement between the patient support apparatus 100 and the ambulation device 200 does not require the patient support apparatus 100 and the ambulation device 200 move entirely in tandem; however, the ambulation device 200 is constrained from horizontal movement relative to at least a portion of the patient support apparatus 100.

As mentioned, the first coupling member(s) 140, 141 can be positioned adjacent to one of the head end 108 or the foot end 110 such that, when the first coupling member(s) 140, 141 is coupled to the second coupling member 208, the barrier 204 is positioned adjacent to one of the head end 108 and the foot end 110 to form the barrier 204 and prevent patient egress from the head end 108 and/or the foot end 110. The first coupling member 140 is positioned adjacent to the foot end 110 such that, when the first coupling member 140 is coupled to the second coupling member 208, the barrier 204 is positioned adjacent to the foot end 110 to form the barrier 204 and prevent patient egress from the foot end 110 of the patient support apparatus.

Figure 4A:
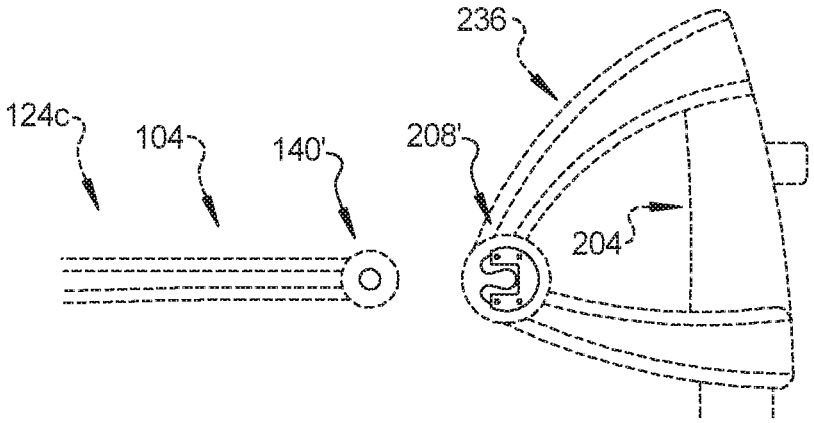
FIG. 4A is a schematic illustration of a first embodiment of coupling members, with a portion of the ambulation device of FIG. 1A shown in phantom.
Figure 4B:
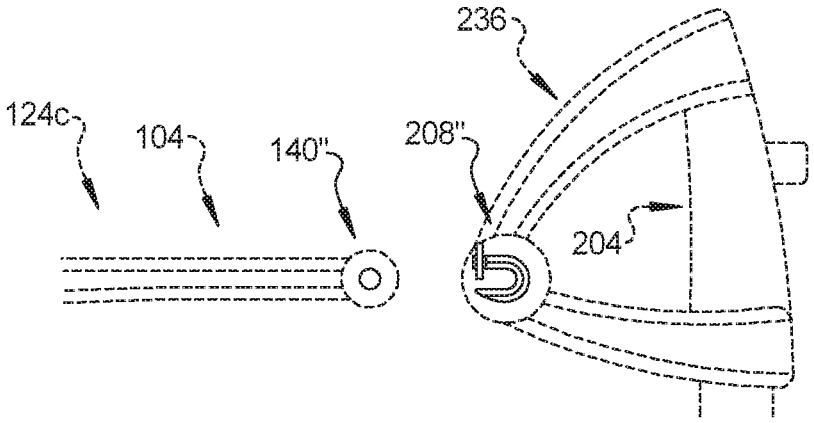
FIG. 4B is a schematic illustration of a second embodiment of coupling members, with a portion of the ambulation device of FIG. 1A shown in phantom.
Figure 4C:
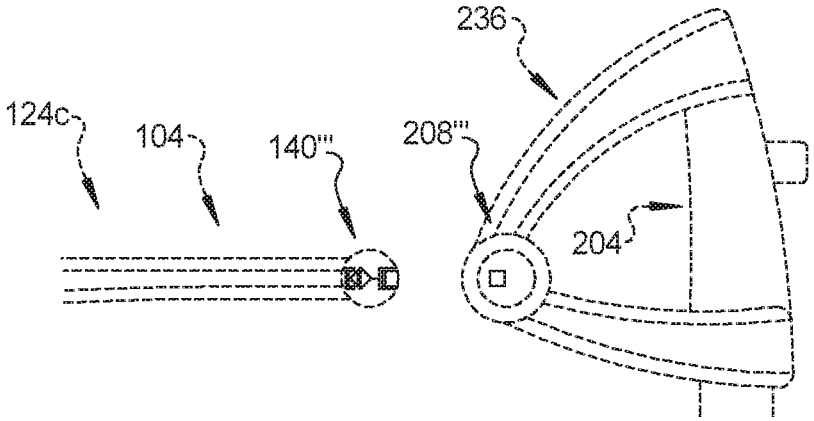
FIG. 4C is a schematic illustration of a third embodiment of coupling members, with a portion of the ambulation device of FIG. 1A shown in phantom.
Figure 5:
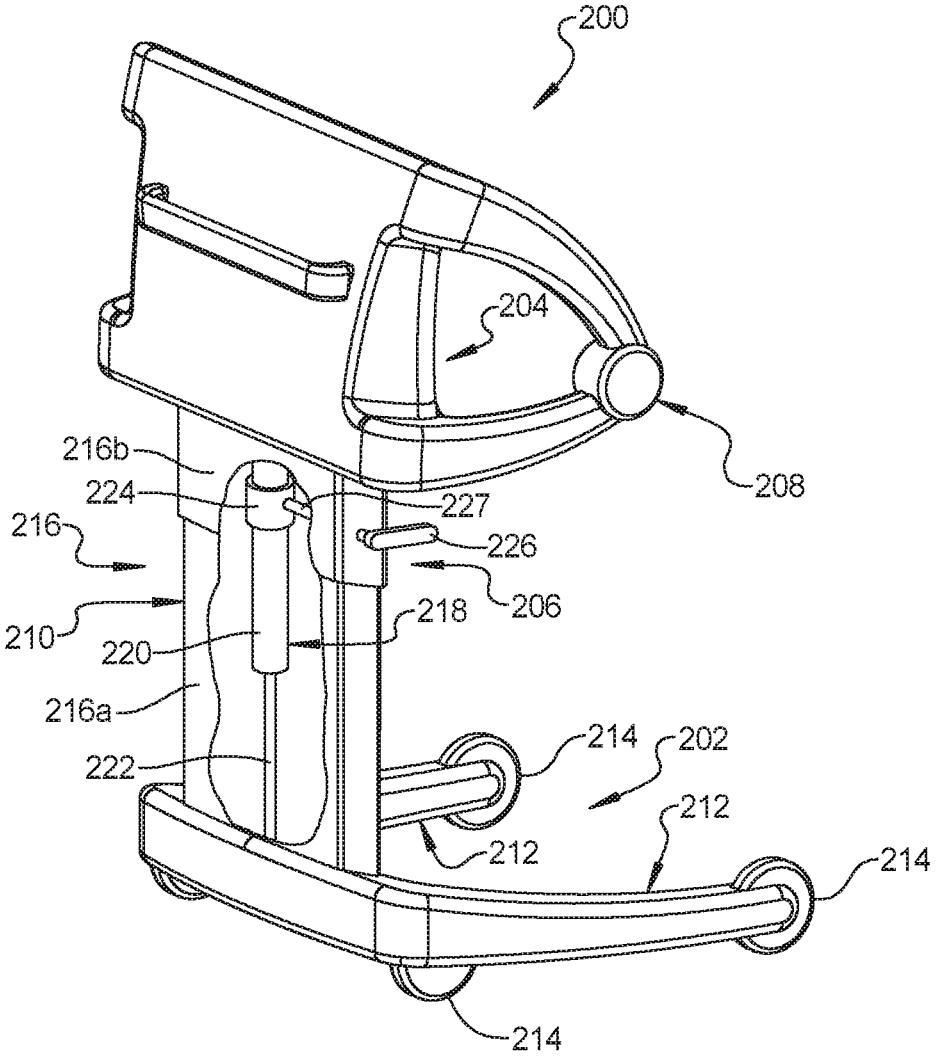
FIG. 5 is a perspective cut-away view of the ambulation device of FIG. 1A, having a second lift device.

Referring to FIGS. 4A-4C, the first coupling member 140 is coupled to the patient support surface 104, and more particularly the patient support surface 104 at the foot section 124*c*. FIGS. 3A, 5 and 9 show the second coupling member 208 coupled to each of the handles 238. Of course, the first coupling member and the second coupling member may be positioned at any suitable location to ensure that the barrier 204 is positioned adjacent to the patient support surface to prevent or limit the gap G therebetween.

In a first embodiment, the coupling members 140, 208 comprise a bear-claw type latch. As commonly understood in the art, the bear claw-type latch comprises an arcuate female component 208' configured to pivot relative to a housing. Upon engagement with a male component 140', the female component 208' mechanically or electromechanically pivots and is locked within the housing. As commonly known in the art, bear claw-type latches can provide an easy-pull release mechanisms work compatible with electric solenoids.

Similarly, in an alternative embodiment of the coupling members, FIG. 4B illustrates a pin-type latch in which a male component 140" comprising a pin can mechanically or electromechanically lock with a female component 208". A solenoid can be incorporated into the pin-type latch in order to control the position of the pin.

FIG. 4C shows an electromagnetic latch in accordance with another exemplary embodiment of the present disclosure. In the embodiment illustrated in FIG. 4C an electric current can be applied to a female component 140'" comprising an electromagnetic device to create a closed magnetic circuit to electromagnetically secure a male component 208".

The present disclosure contemplates any size and shape of coupling members can be incorporated. FIGS. 4A-4C illustrate non-limiting means for removably coupling the patient support apparatus 100 and the ambulation device 200.

FIG. 5 shows perspective view of the ambulation device 200 including a schematic illustration of a second lift device 206 in accordance with another exemplary embodiment of the present disclosure. In the illustrated embodiment, the second lift device 206 comprises a gas spring 218. As commonly understood in the art, gas springs use a compressed gas, contained in a cylinder and compressed by a piston, to exert a force.

The gas spring 218 is coupled to the back 210 of the support frame 202, however, the present disclosure contemplates other locations to couple the gas spring 218 on the support frame 202 provided the gas spring 218 moves the barrier 204 relative to the support frame 202. The gas spring 218 may comprise a housing 220 and a movable element 222. The housing 220 can be a cylinder and the moveable element 222 can be a piston. The housing 220 and the moveable element 222 are configured to adjust the elevation of the barrier 204 relative to the support frame 202, or provide an assist to a caregiver who wishes to adjust the elevation of the barrier 204. In doing so, the second section 216*b* slides relative to the first section 216*a*. The gas spring 218 can be disposed within the first section 216*a* and the second section 216*b*, or otherwise coupled to the first section 216*a* and/or the second section 216*b*. In other words, the first section 216*a* and the second section 216*b* can comprise a casing for the gas spring 218 of the second lift device 206, or comprise a functional component that transfers forces from actuation of the gas spring 218 to move the barrier 204 relative to the support frame 202.

Furthermore, the gas spring 218 can further comprise a locking element 224. The locking element 224 is operable in a locked configuration and an unlocked configuration. In the locked configuration, the locking element 224 prevents movement of the movable element 222 relative to the housing 220 to maintain the elevation of the barrier 204 relative to the support frame 202. Conversely, in the unlocked configuration, the locking element 224 permits movement of the movable element 222 relative to the housing 220 to change the elevation of the barrier 204 relative to the support frame 202. The locking element 224 can comprise a valve configure to maintain the internal pressure of the gas spring 218, and thus maintaining the elevation of the barrier 204 relative to the support frame 202 when the pressure valve is closed. When the valve is opened, the compressed gas of the cylinder is permitted to enter or escape, permitting movement of the barrier relative to the support frame 202. The ambulation device 200 can further comprise a lock actuator 226 coupled to the locking element 224. The lock actuator 226 can comprise a component of the second lift device 206. The locking actuator 226 is configured to move the locking element 224 between the locked configuration and the unlocked configuration. In the exemplary embodiment illustrated in FIG. 5, the lock actuator 226 is a mechanical handle configured to receive an input by the caregiver. In the exemplary embodiment, the handle is coupled to the locking element 224 via a linkage 227. In another aspect, the lock actuator 226 is an electromechanical switch operably coupled to the locking element 224 and configured to receive an output from a controller. The electromechanical switch operably controls the valve to selectively maintain the internal pressure of the cylinder, as disclosed herein.

Figure 6:
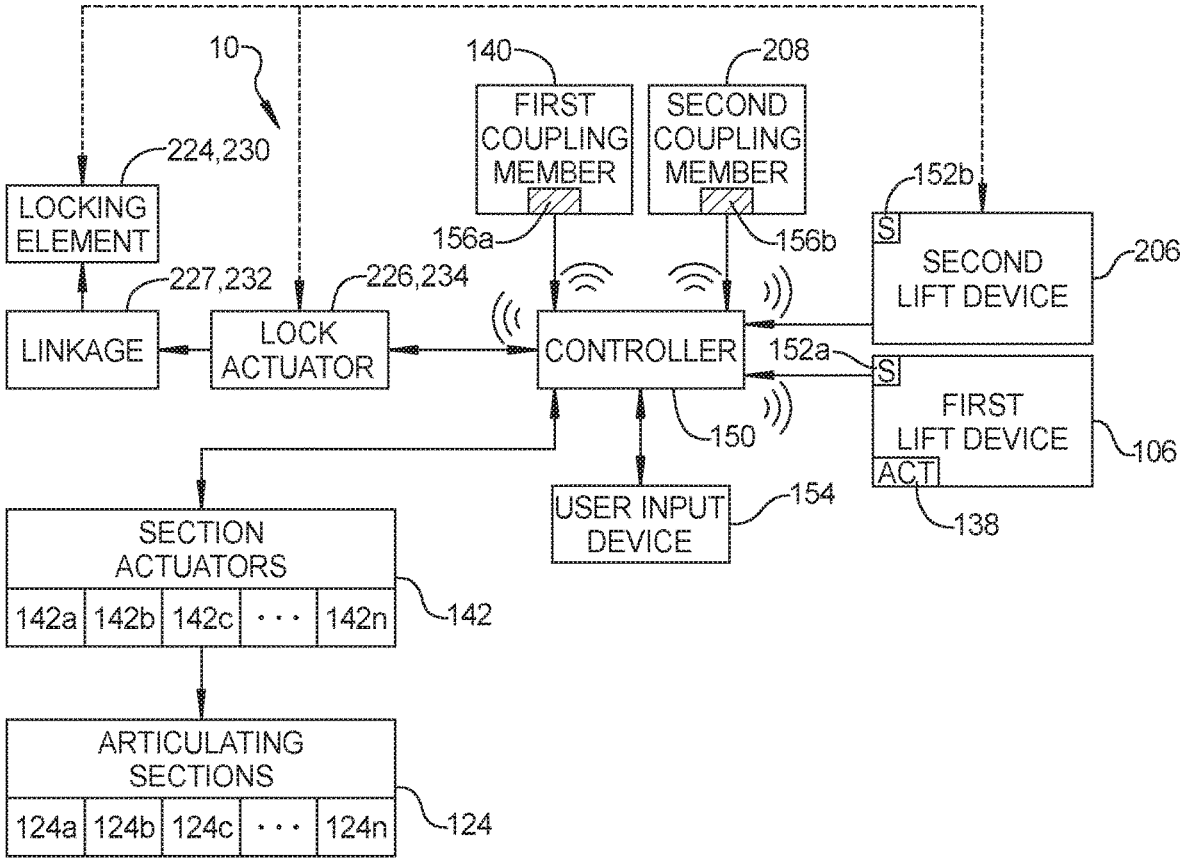
FIG. 6 is a schematic illustration of the patent mobility system of FIG. 1A.

FIG. 6 is schematic diagram of a patient mobility system 10 showing the electronic controls in accordance with an exemplary embodiment of the present disclosure. The controller 150 can be in electronic communication with the first lift device 106, the second lift device 206, the articulating sections 124, the first coupling member 140, the second coupling member 208, among other components as disclosed herein. The electronic communication can be through wired or wireless means without deviating from the objects of the present disclosure.

In certain embodiment, an advantage of the present disclosure is the ambulation device 200 being a functional component of the patient mobility system 10 in the coupled configuration and the uncoupled configuration. In the coupled configuration, the barrier 204 of the ambulation device 200 prevents egress from the patient support apparatus 100. When not coupled to the patient support apparatus 100, the ambulation device 200 provides support to a patient during ambulation away from the patient support apparatus 100. Those skilled in the art readily appreciate that an ambulation device 200, such as a walker, is typically adjustable to provide comfort to each unique patient during ambulation, and the second lift device 206 provides the adjustable elevation. The ambulation device 200 can be adjustable to any desired elevation between a minimum and a maximum. Additionally or alternatively, the second lift device 206 of the ambulation device 200 can include preset elevation positions. For example, the second lift device 206 can be configured to adjust elevation in six inch, eight inch, or one foot amounts in response to an input from the patient. For another example, the preset elevation positions can be programmed by the patient based on their personal preferences. Selection of a previously programmed "stand/walk" setting can adjust the elevation of the ambulation device 200 to the preprogrammed elevation. The adjustment in elevation can adjust the grip 236 to a position most comfortable for the patient.

Further, the ambulation device 200 can include a brake mechanism controllable by the patient. The brake mechanism can comprise an actuator mounted in a suitable location to be actuated by a hand of the patient. The actuator is operably coupled to a brake, via a cable or otherwise, to selectively couple the brake and the wheel of the ambulation device to slow or stop the ambulation device.

A patient support apparatus 100, such as a hospital bed, is typically adjustable for patient care and comfort, and the first lift device 106 provides the adjustable elevation. In other words, the patient support apparatus 100 and the ambulation device 200 each comprise a lift mechanism 106, 206 adapted to be independently control the respective elevation of the patient support surface 104 and the barrier 204 when the patient support apparatus 100 and the ambulation device 200 are not coupled.

In the coupled configuration, however, adjusting the elevation of one of the patient support apparatus 100 and the ambulation device 200 typically requires a corresponding movement or action in response from the other. Therefore, a further object and advantage of the present disclosure is to provide the patient mobility system 10 that effectively coordinates movement or actions the patient support apparatus 100 and the ambulation device 200 in the coupled configuration.

The controller 150 is configured to determine a state of the first lift device 106 and/or the second lift device 206. For example, the controller 150 determines the elevation of the patient support surface 104 relative to the base 102 and the elevation of the barrier 204 relative to the support frame 202. In response to a change in the elevation of the first lift device 106 and/or the second lift device 206, the controller 150 is configured to transmit an output signal to at least one of the first lift device 106 and/or the second lift device 206 to maintain relative positioning, i.e., height, of the patient support surface 104 and the barrier 204 in the coupled configuration.

More specifically, the controller 150 may continuously monitor the elevation of the first lift device 106 and/or the second lift device 206 with one or more sensors 152, such as position encoders. To do so, the controller 150 can be calibrated to register a particular elevation with an initial value as measured by a first lift sensor 152*a* and a second lift sensor 152*b* associated with each of the first lift device 106 and the second lift device 206, respectively. As the value changes from the initial valve as measured by the lift sensors 152, the controller 150 determines the change in the elevation. The controller 150 can electronically control the actuators 138 of the first lift device 106 and/or the gas spring 218 of the second lift device 206 to provide a corresponding movement or action in response, such as a corresponding change in elevation, from one of the first lift device 106 and/or the second lift device 206.

In at least some aspects of the present disclosure, the operation of the first lift device 106 and the second lift device 206 may be harmonized in a suitable manner in order to provide corresponding movement or action in response to a change in the elevation of either the patient support surface 104 or the barrier 204. Stated differently, upon an input to change the elevation of either the patient support surface 104 or the barrier 204, the patient mobility system 10 is configured to change the elevation of the other to maintain the relative position of the barrier 204 and the patient support surface 104 when the ambulation device 200 is coupled to the patient support apparatus 100 Consequently, upon raising or lowering the patient support apparatus 100 or the ambulation device 200, the barrier 204 maintains the height sufficient to at least partially extend above the patient support surface 104. Thus, no matter the desired elevation of the patient support surface 104, the barrier 204 prevents patient egress and the ambulation device 200 and is a functional component of the patient support apparatus 100 in the coupled configuration.

For the controller 150 to maintain relative positioning between the patient support surface 104 and the barrier 204 in the coupled configuration, the controller 150 requires input as to whether or not the patient support apparatus 100 and the ambulation device 200 are coupled. In such an embodiment, the first coupling member 140 and/or the second coupling member 208 comprise a coupling sensor

156*a*, 156*b* configured to determine whether the first coupling member 140 is engaged with the second coupling member 208. The engagement can be electromechanical, magnetic, or otherwise. The coupling sensor(s) 156 are in electronic communication with the controller 150, either wired or wirelessly, and configured to provide a coupling input signal to the controller 150. The controller 150 is configured to transmit an output signal to at least one of the first lift device 106 and the second lift device 206 based, at least in part, on the coupling input signal. The controller 150 can also be in wireless communication with the first lift device 106 and/or the second lift device 206.

Figure 7A:
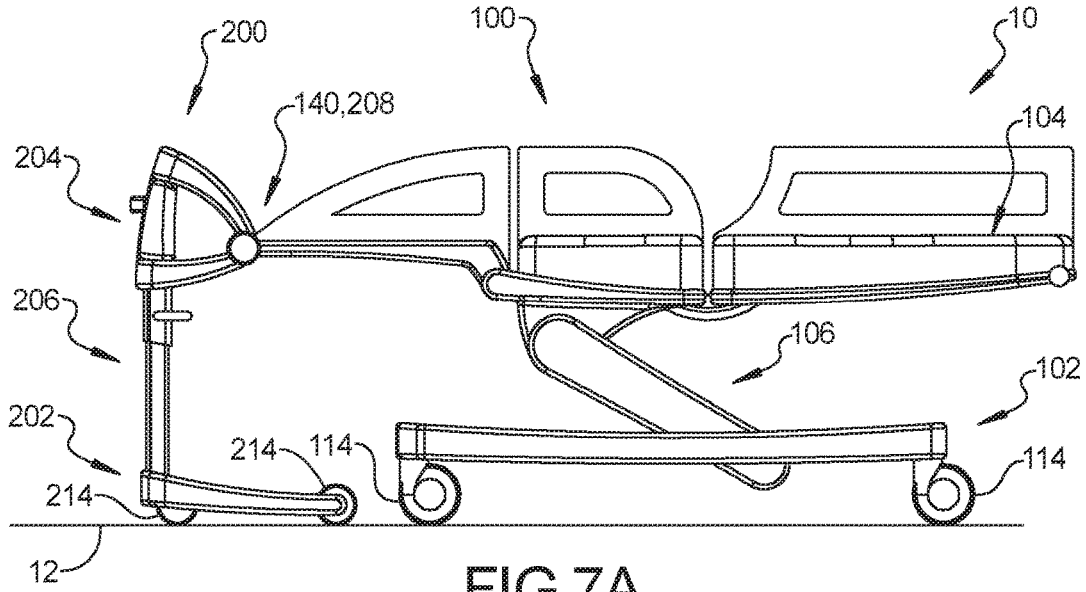
FIG. 7A is a side elevation view of the patent mobility system of FIG. 1A in a raised position, with the ambulation device shown coupled to the patient support apparatus.
Figure 7B:
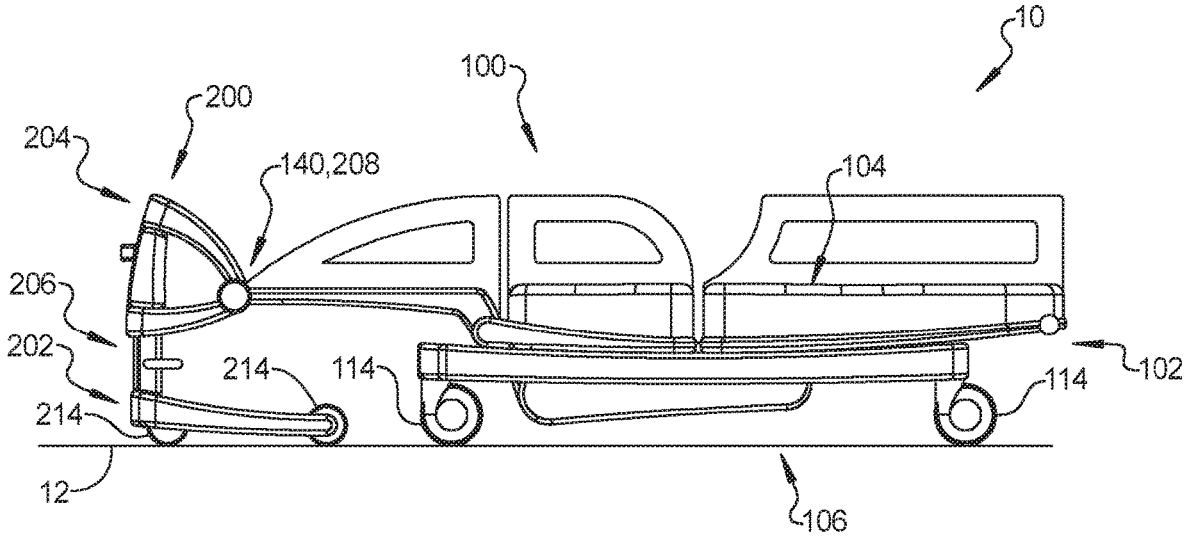
FIG. 7B is a side elevation view of the patent mobility system of FIG. 1A in a lowered position relative to FIG. 7A, with the ambulation device shown coupled to the patient support apparatus.
Figure 7C:
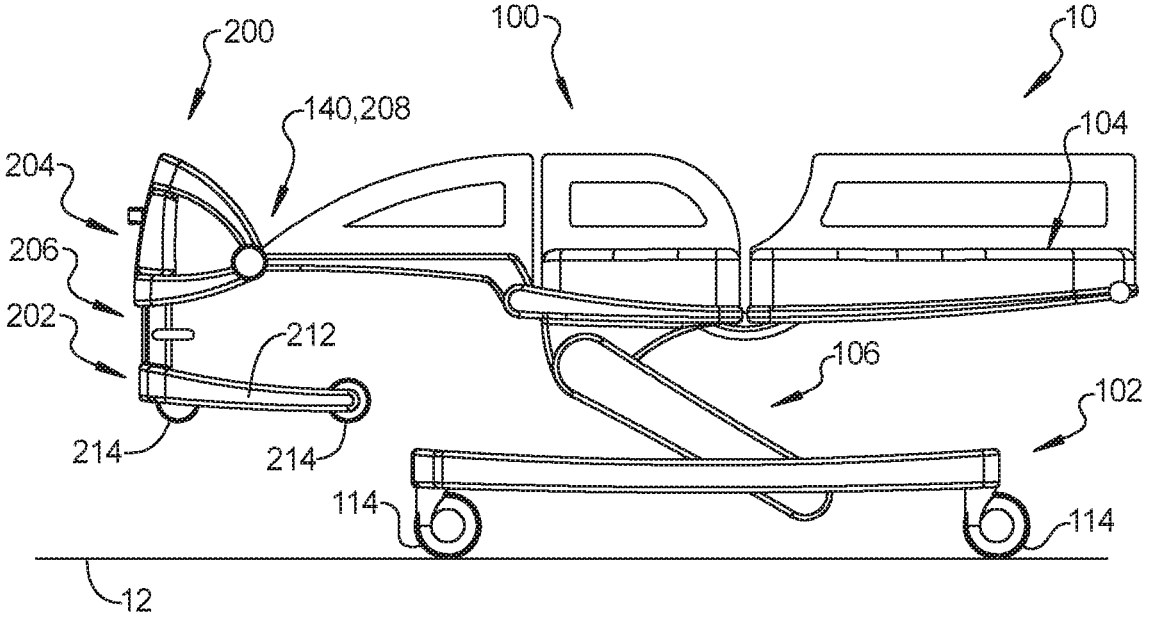
FIG. 7C is a side elevation view of the patent mobility system of FIG. 1A in a raised position, with the ambulation device shown coupled to the patient support apparatus and the second lift device in a retracted position.

As previously disclosed, the controller 150 detects the change in elevation of the patient support surface 104 relative to the base 102, and consequently controls the second lift device 206. For example, the patient support apparatus 100 and the ambulation device 200 are in the coupled configuration, as illustrated in FIGS. 7A-7C, and the coupling sensor(s) 156 provide the coupling input signal to the controller 150. The patient mobility system 10 of FIG. 7A is shown in a raised position having a generally higher elevation relative to FIG. 7B. An input is provided to the controller 150 typically through a user input device 154 (FIG. 6) in electronic communication with the controller 150. The user input device 154 can comprise tactile buttons and/or touchscreen features, a voice recognition system, a graphic user interface (GUI), and/or or any other suitable interface to receive input of the user. The user input device 154 can be coupled to the patient support apparatus 100 at a suitable location easily accessible by a caregiver, and/or disposed on a remote device such as a handheld device usable by the patient while resting upon the patient support apparatus 100.

A user (e.g., caregiver, patient, etc.) may desire to lower or raise the patient mobility system 10. For example, the patient mobility system 10 is lowered from the representative position illustrated in FIG. 7A to the representative position illustrated in FIG. 7B. An input is provided from the user to the user input device 154, which transmits a signal to the controller 150 to adjust the elevation of the patient support apparatus 100. The controller 150 directs the actuator(s) 138 of the first lift device 106 to lower the elevation of the patient support surface 104 relative to the base 102.

When the coupling input signal indicates that the ambulation device 200 and the patient support apparatus 100 are in the coupled configuration, the controller 150 can be configured to provide a corresponding movement or action in response. One such corresponding action in response comprises the controller 150 actuating the lock actuator 226 to cause the linkage 227 to move the locking element 224 from the locked configuration to the unlocked configuration so as to permit compression or expansion of the gas spring 218 to lower or raise, respectively, the elevation of the barrier 204 relative to the support frame 202. In one aspect of the present disclosure, the corresponding action in response can occur after the caregiver provides input to change an elevation of the patient support surface 104 relative to the base 102. In another aspect of the present disclosure, the locking element 224 is moved to the unlocked configuration automatically upon the coupling signal first indicating that the ambulation device 200 and the patient support apparatus 100 are in the coupled configuration.

During lowering of the patient mobility system 10, the downward force from the patient support apparatus 100 compresses of the gas spring 218. The downward force is transferred from the patient support apparatus 100 to the ambulation device 200 via the coupling members 140, 208. As commonly understood in the art, a gas spring requires an external compressive force to compress the spring. Conversely, in the absence of external forces (other than the weight supported by the gas spring, which is factored into the design of the gas spring itself), the gas spring expands until the internal and external pressures equalize. In the lowered position, the internal pressure of the gas spring 218 exceeds the external pressure. Thus, when raising the patient support apparatus 100, the gas spring 218 expands to raise the elevation of the barrier 204 relative to the support frame 202. The expansion of the gas spring 218 is constrained only by the downward force from the patient support apparatus 100. Consequently, the expansion of the gas spring 218 corresponds to the change in the elevation of the patient support surface 104 relative to the base 102. The relative position of the barrier 204 is maintained when lowered or raised together with the patient support apparatus 100. The barrier 204 maintains the height sufficient to at least partially extend above the patient support surface 104 so as to prevent patient egress from the patient support apparatus 100.

The corresponding movements of the first lift device 106 and the second lift device 206 can maintain contact between the wheels 114, 214 and the floor surface 12. Thus, in the raised position and the lowered position illustrated in FIGS. 7A and 7B, respectively, and any position therebetween, the wheels 114, 214 rest upon the floor surface 12 to facilitate transport of the patient mobility system 10.

FIG. 7C illustrates another exemplary manner in which relative positioning of the barrier 204 and the patient support surface 104 is maintained upon a change in the elevation of the patient support surface 104 relative to the base 102. FIG. 7C generally illustrates retraction of the ambulation device 200 when the coupling input signal indicates that the ambulation device 200 and the patient support apparatus 100 are in the coupled configuration so as to lift the support frame 202 of the ambulation device 200 off of the floor surface 12. The controller 150 is configured to transmit the output signal to the second lift device 206 to cause retraction of the second lift device 206. The retraction of the second lift device 206 lifts the support frame 202 of the ambulation device off of the floor surface 12, as illustrated in FIG. 7C. The retraction of the second lift device 206 comprises the feet 212 moving in a direction towards the barrier 204 such that the wheels 214 are no longer in contact with the floor surface 12. The controller 150 permits retraction of the second device 206 when the coupling input signal indicates that the ambulation device 200 and the patient support apparatus 100 are in the coupled configuration.

Referring first to FIG. 7B, the patient mobility system 10 is shown in a generally lowered position with the patient support apparatus 100 and the ambulation device 200 in the coupled configuration. In the lowered position, the wheels 114 of the patient support apparatus 100 and the wheels 214 of the ambulation device 200 rest upon the floor surface 12. The controller 150 actuates the lock actuator 226 to cause the linkage 227 to move the locking element 224 from the locked configuration to the unlocked configuration. As previously disclosed, in the unlocked configuration, compression or expansion of the gas spring 218 is permitted, thereby permitting the movement of the movable element 222 relative to the housing 220 to change the elevation of the barrier 204 relative to the support frame 202. As the patient support surface 104 moves upwardly relative to the base 102, the barrier 204 moves upwardly relative to the support frame 202 to a generally raised position in FIG. 7A.

The retraction of the ambulation device 200 may or may not occur immediately upon ambulation device 200 and the patient support apparatus 100 enter the coupled configuration. In one aspect of the present disclosure, the position of the barrier 204 relative to the support frame 202 can be maintained after the ambulation device 200 is coupled to the patient support apparatus 100. Should the patient support surface 104 moves upwardly relative to the base 102, the ambulation device 200 lifts off the floor surface 12. Should the patient support surface 104 moves downwardly relative to the base 102, the ambulation device 200 lifts off the floor surface 12, compression of the gas spring 218 is permitted, thereby permitting the barrier 204 to move downwardly relative to the support frame 202 whose downward movement constrained by the floor surface 12. Should the user desire retraction of the ambulation device 200, an input is provided to the controller 150 to transmit the output signal to the second lift device 206 to cause retraction of the second lift device 206.

In other aspects of the present disclosure, the patient mobility system 10 is configured to move between the representative positions illustrated in FIGS. 7B and 7C without passing through an intervening representative position illustrated in FIG. 7A. The locking element 224 remains in the locked configuration despite the ambulation device 200 and the patient support apparatus 100 being in the coupled configuration, either as a result of the input from the user and/or a setting of the controller 150. In the locked configuration, the locking element 224 prevents movement of the second lift device 206, and more particularly the moveable element 222 relative to the housing 220, to maintain the elevation of the barrier 204 relative to the support frame 202.

Upon increasing the elevation of the patient support surface 104 relative to the base 102, the ambulation device 200 is constrained from correspondingly increasing the elevation of the barrier 204 relative to the support frame 202. The second lift device 206 remains retracted and the support frame 202 of the ambulation device 200 is elevated off of the floor surface 12.

Once assuming the representative position illustrated in FIG. 7C, the second lift device 206 of the ambulation device 200 can be expanded to lower the legs 212 of the support frame 202 such that wheels 214 come into contact and rest upon the floor surface 12, after which the patient mobility system 10 assumes the representative position illustrated in FIG. 7A. To do so, the controller 150 actuates the lock actuator 226 to cause the linkage 227 to move the locking element 224 from the locked configuration to the unlocked configuration. In the unlocked configuration, the locking element 224 permits movement of the second lift device 206, and more particularly the moveable element 222 relative to the housing 220, to increase the elevation of the barrier 204 relative to the support frame 202 (i.e., the support frame 202 is lowered preferably until the wheels 214 come into contact with the floor surface 12).

In FIG. 7C, the weight of the ambulation device 200 is fully supported by the patient support apparatus 100. Any suitable structures may be incorporated to minimize stress on the coupling members 140, 208 when the ambulation device 200 is retracted off of the floor surface 12, including but not limited to linkages, support members, and the like.

The retraction of the second lift device 206 can be automatic or after input from a user via the user input device 154. As previously disclosed herein, the coupling sensor(s) 156 are in electronic communication with the controller 150 and configured to provide a coupling input signal to the controller 150 when the first coupling member 140 is engaged with the second coupling member 208. The controller 150 is configured to transmit an output signal to at least one of the first lift device 106 and the second lift device 206 based, at least in part, on the coupling input signal. Thus, should the ambulation device 200 initially be positioned away from the patient support apparatus 100, after which the ambulation device 200 is coupled to the patient support apparatus 100, the controller 150 can automatically instruct, via the output signal, the second lift device 206 to retract. Alternatively, the controller 150 can be configured to not instruct the second lift device 206 to retract until an input is provided by a user via the user input device 154 to do so.

In the exemplary embodiment illustrated in FIGS. 7A-7C, the height of the barrier 204 remains above the patient support surface 104 regardless of the elevation of the patient support surface 104 relative to the base 102, the elevation of the barrier 204 relative to the support frame 202, and/or whether the second lift device 206 is retracted. The barrier 204 is a functional component of the patient support apparatus 100 in the coupled configuration by maintaining a height sufficient to at least partially extend above the patient support surface 104 to prevent patient egress, regardless of the various positions achievable by the patient mobility system 10.

Figure 8:
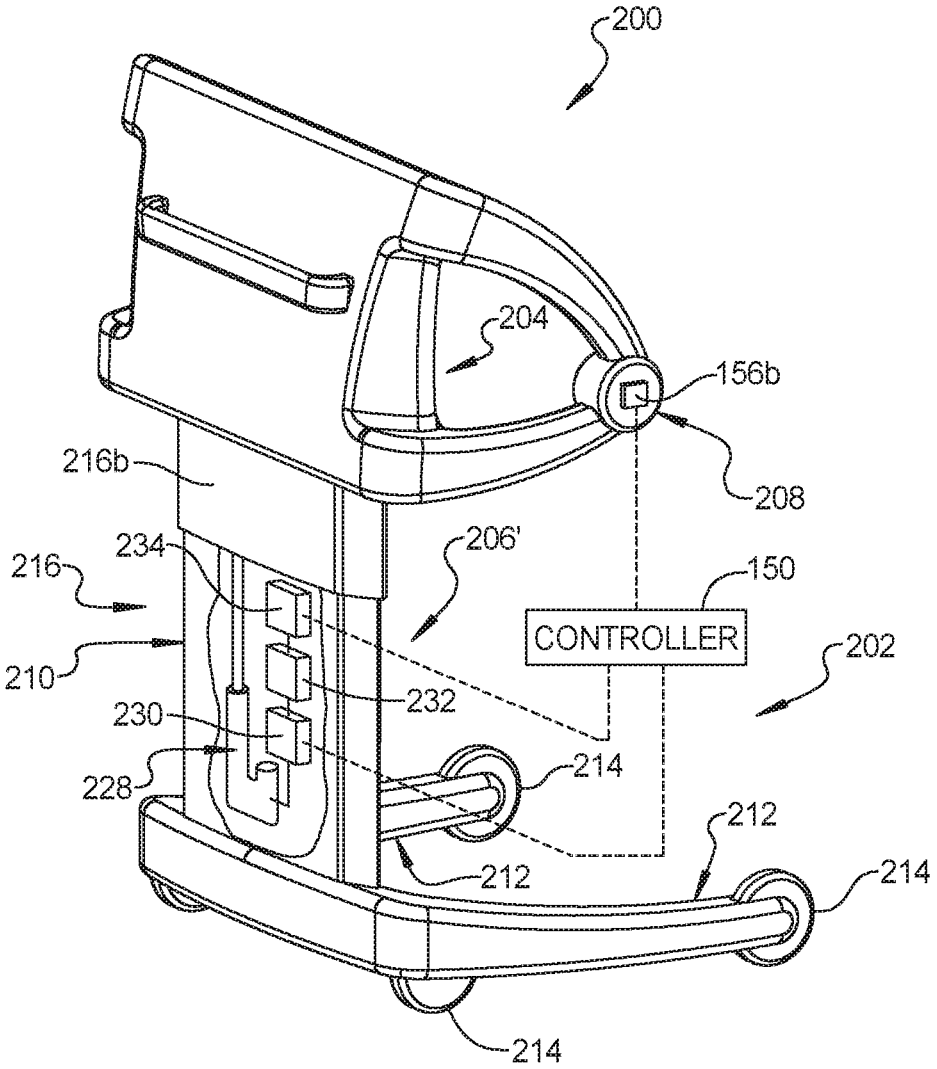
FIG. 8 is perspective cut-away view of the ambulation device, with a schematic view of a second embodiment of the ambulation device.

FIG. 8 comprises schematic illustration of a second lift device 206' in accordance with another exemplary embodiment of the present disclosure. In many respects the function of the second lift device 206' illustrated in FIG. 8 is similar to the function of the exemplary embodiment of the second lift device 206 illustrated in FIG. 5. Whereas the exemplary embodiment illustrated in FIG. 5 comprises a gas spring 218, the second lift device 206' of FIG. 8 comprises any suitable actuator 228 capable of adjusting the elevation of the barrier 204 relative to the support frame 202. The actuator 228 can be a hydraulic, pneumatic, electric, mechanical, electromechanical, and/or electromagnetic actuator capable of imparting a linear motion of the barrier 204 relative to the support frame 202. An exemplary electromechanical actuator comprises a worm gear driven by an electric motor. An exemplary electromagnetic actuator comprises an armature linearly movable within a solenoid. The second lift device 206' can further comprise any supplemental components required by a particular type of actuator 228 (e.g., gearing, belts, tubing, bearings, etc.).

A locking element 230 is operably connected to the actuator 228 and operable between the locked configuration and the unlocked configuration. The locking element 230 can be an electromechanical or electromagnetic switch, hydraulic or pneumatic valve, and the like. A linkage 232 can be operably coupled to the locking element 230 configured to move the locking element 230 between the locked configuration and the unlocked configuration. A lock actuator 234 is coupled to the linkage 232 can be in electronic communication with a controller 150, as illustrated in FIG. 8. The controller 150 is configured to actuate the lock actuator 234 to cause the linkage 232 to move the locking element 230 between the locked configuration and the unlocked configuration.

Additionally or alternatively, the second lift device 206 can comprise a clutch mechanism (not shown) such that the elevation of the barrier 204 relative to the support frame 202 can be adjusted without operation of backdrive of the second lift device 206. The clutch mechanism can automatically disengage the motor of the second lift device 206 when the ambulation device 200 and the patient support apparatus 100 enter or are in the coupled configuration. This allows the ambulation device 200 to provide a corresponding movement or action in response to a change in state of the patient support apparatus 100 with operation or backdrive of the actuator 228 of the second lift device 206. The second lift device 206' is controlled by the controller 150 to cause the ambulation device 200 to provide a corresponding movement or action in response to a change in state of the patient support apparatus 100, as previously disclosed herein, when the ambulation device 200 and the patient support apparatus 100 are in the coupled configuration.

In the exemplary embodiment of FIG. 8, the controller 150 transmits an output signal to at least one of the first lift device 106 and/or the second lift device 206' to maintain relative positioning of the patient support surface 104 and the barrier 204 in the coupled configuration. The controller 150 continuously monitors the state, i.e., elevation, of the first lift device 106 and/or the second lift device 206'. The controller 150 can electronically control the actuator(s) 138 of the first lift device 106 and/or the actuator 228 of the second lift device 206' to provide a corresponding movement or action in response, such as a corresponding change in elevation, from one of the first lift device 106 and/or the second lift device 206. Each of the first lift device 106 and the second lift device 206' independently control the elevation of the patient support surface 104 and the barrier 204, respectively, when the patient support apparatus 100 and the ambulation device 200 are not coupled. In the coupled configuration, however, the controller 150 is adapted to harmonize the movements of the patient support apparatus 100 and the ambulation device 200 as disclosed herein.

For example, an input is provided from the user to the user input device 154 instructs the controller 150 to adjust the elevation of the patient support apparatus 100. The controller 150 directs the actuator(s) 138 of the first lift device 106 to lower the elevation of the patient support surface 104 relative to the base 102. The controller 150 detects the change in elevation of the patient support surface 104 relative to the base 102 in response to input provided from the user to the user input device 154 to adjust the elevation of the patient support apparatus 100. Whereas the gas spring 218 embodiment may require moving the lock actuator 226 (via the linkage 227) to the unlocked configuration, the second lift device 206' of the embodiment of FIG. 8 may not require a discrete lock actuator 234 and linkage 232. Rather, the locking element 230 and the actuator 228 may be electronically controlled directly by the controller 150. In other words, the electric linear actuator or similar device may not require the mechanical components associated with a gas spring. FIG. 8 illustrates the locking element 230, the linkage 232, and the lock actuator 234 associated with the second lift device 206', as one or more of the locking element 230, linkage 232, and/or lock actuator 234 may be required based on the specific type of actuator 228 utilized.

Upon detection of the change in the elevation of the patient support surface 104 relative to the base 102, the controller 150 transmits the output signal to instruct the actuator 228 of the second lift device 206' to perform corresponding movement or action in response. Should the patient support apparatus be lowered from the representative position of FIG. 7A to the representative position of FIG. 7B, the controller 150 instructs the actuator 228 to correspondingly adjust the elevation the barrier 204 relative to the support frame 202. Likewise, should the patient support apparatus be raised from the representative position of FIG. 7B to the representative position of FIG. 7A, the controller 150 instructs the actuator 228 to correspondingly adjust the elevation of the barrier 204 relative to the support frame 202. Thus, in the coupled configuration, the height of the barrier 204 remains above the patient support surface 104 regardless of the elevation of the patient support surface 104 relative to the base 102.

The second lift device 206' can be retracted when the coupling input signal indicates that the ambulation device 200 and the patient support apparatus 100 are in the coupled configuration. The controller 150 transmits the output signal to the second lift device 206 to cause retraction of the second lift device 206. The retraction of the second lift device 206 lifts the support frame 202 of the ambulation device off of the floor surface 12, as illustrated in FIG. 7C. The retraction of the second lift device 206 is generally associated with the feet 212 moving in a direction towards the barrier 204 such that the wheels 214 are no longer in contact or rest upon the floor surface 12.

In other aspects of the present disclosure, the patient mobility system 10 is configured to move between the representative position illustrated in FIGS. 7A and 7C without passing through an intervening representative position illustrated in FIG. 7B. In such an exemplary embodiment, the controller 150 maintains the elevation of the barrier 204 relative to the support frame 202 despite the change in elevation of the patient support surface 104 relative to the base 102. Consequently, the second lift device 206' remains retracted and the support frame 202 of the ambulation device is lifted off the floor surface 12 and assumes the representative position illustrated in FIG. 7C.

Thereafter, the controller 150 can further instruct the second lift device 206' of the ambulation device 200, to lower the legs 212 of the support frame 202 such that wheels 214 come into contact and rest upon the floor surface 12. The patient mobility system 10 assumes the representative position illustrated in FIG. 7A.

Similar to the embodiment using a gas spring, the retraction of the second lift device 206' of FIG. 8 can be automatic or after input from a user via the user input device 154. The coupling sensor 156 in electronic communication with the controller 150 provides a coupling input signal to the controller 150 when the first coupling member 140 is engaged with the second coupling member 208. The controller 150 transmits an output signal to at least one of the first lift device 106 and the second lift device 206' based, at least in part, on the coupling input signal. Thus, should the ambulation device 200 initially be positioned away from the patient support apparatus 100, after which the ambulation device 200 is coupled to the patient support apparatus 100, the controller 150 can automatically instruct, via the output signal, the second lift device 206 to retract. Alternatively, the controller 150 can be configured to not instruct the second lift device 206 to retract until an input is provided by a user via the user input device 154.

The height of the barrier 204 remains above the patient support surface 104 regardless of the elevation of the patient support surface 104 relative to the frame, the elevation of the barrier 204 relative to the support frame 202, and/or whether the second lift device 206' is retracted. Thus, as with the exemplary embodiment illustrated in FIGS. 7A and 7B, the barrier 204 is a functional component of the patient support apparatus 100 in the coupled configuration by maintaining a height sufficient to at least partially extend above the patient support surface 104 to prevent patient egress.

Referring to FIGS. 9A-9F, the patient support apparatus 100 is illustrated in various configurations in accordance with an exemplary embodiment of the present disclosure. As previously disclosed herein, the patient support apparatus 100 can comprise articulating sections 124. FIGS. 9A-9F show a head section 124*a*, a seat section 124*b*, and a foot section 124*c*. The articulating sections 124*a*, 124*b*, 124*c* are configured to articulate the patient support surface 104 at least between a bed configuration, a chair configuration, and any configuration therebetween.

Figure 9A:
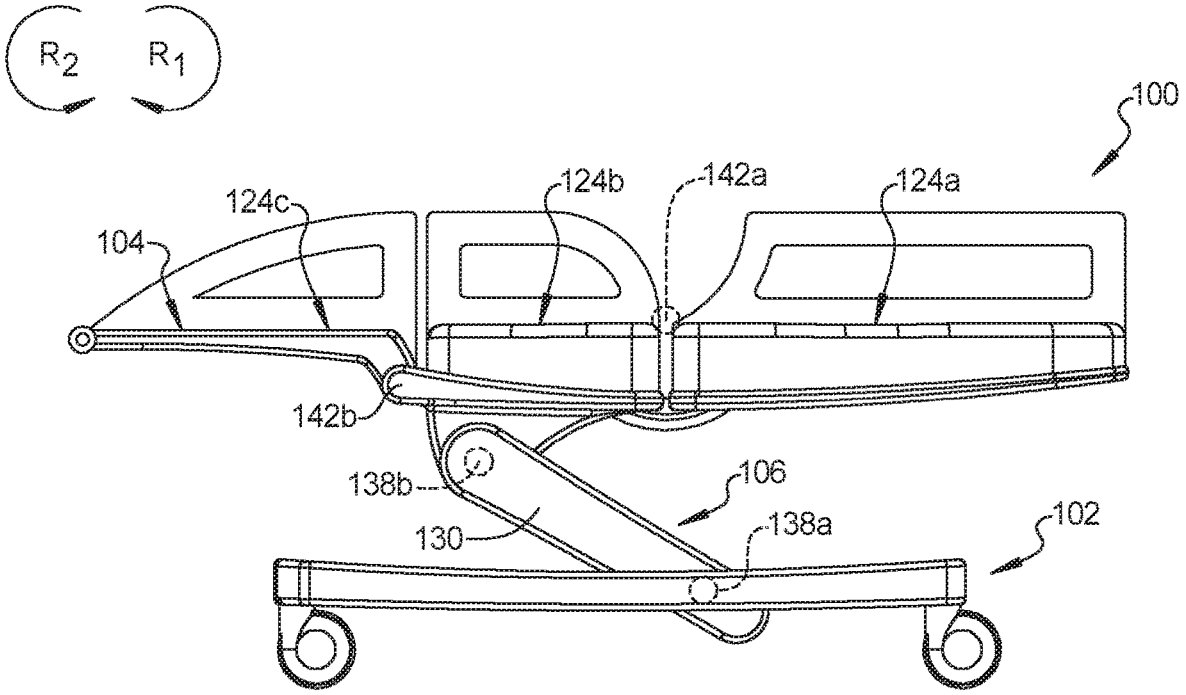
FIG. 9A is a side elevation view of the patient support apparatus of FIG. 1A with the patient support surface in a bed configuration.
Figure 9B:
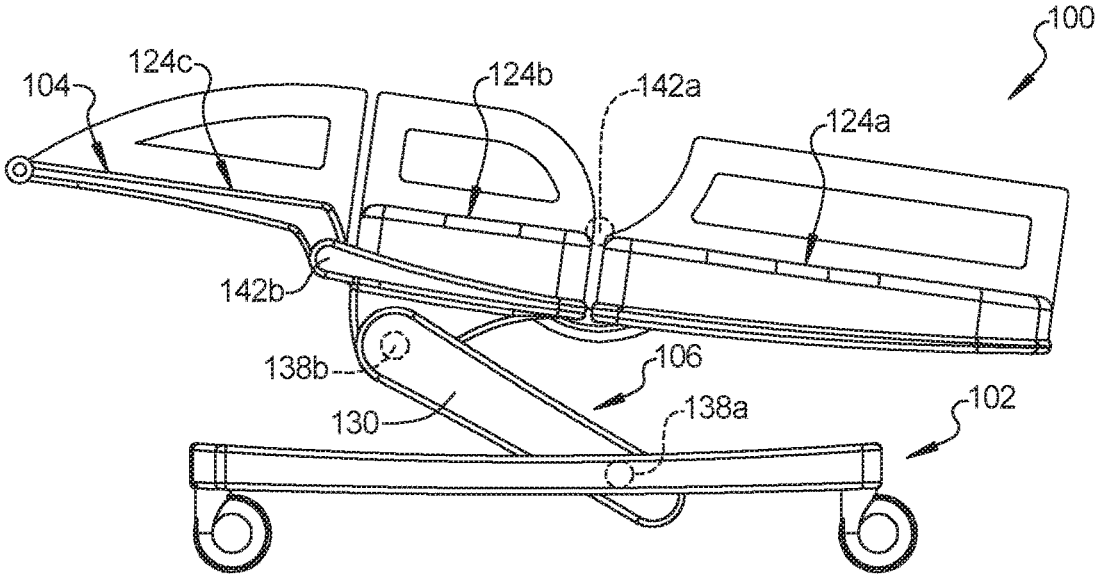
FIG. 9B is a side elevation view of the patient support apparatus of FIG. 9A in the bed configuration with the patient support surface in a reverse Trendelenburg position.

FIG. 9A illustrates the patient support apparatus 100 in a bed configuration. More specifically, the articulating sections 124*a*, 124*b*, 124*c* collectively define a generally planar patient support surface 104. The first lift device 106 comprises a lifting arm 130 coupled to the base 102 and the patient support surface 104. The first lift device 106 can further comprise one or more actuators 138 configured to impart relative motion between coupled structures of the patient support apparatus 100. A first actuator 138*a* pivots the lifting arm 130 relative to the base 102 in one of a first radial direction R1 and second radial direction R2, and a second actuator 138*b* pivots the patient support surface 104 relative to the lifting arm 130 in one of a first radial direction R1 and second radial direction R2. Collectively, the first actuator 138*a* and the second actuator 138*b* can change the elevation of the patient support surface 104 relative to the base 102 while maintaining a generally horizontal patient support surface 104. If desired, the first actuator 138*a* and the second actuator 138*b* can impart different magnitudes of angular displacement to orient the patient support surface 104 in a tilted position. FIG. 9B illustrates the patient support apparatus 100 in the bed configuration and in the reverse Trendelenburg position.

The patient support apparatus 100 can comprise section actuators 142 coupled to the articulating sections 124*a*, 124*b*, 124*c*. The section actuators 142 cause relative movement between two adjacent articulating sections 124*a*, 124*b*, 124*c*. The relative movement is typically through pivoting one of the articulating sections 124*a*, 124*b*, 124*c* relative to an adjacent one of the articulating sections 124*a*, 124*b*, 124*c*, but relative linear movement is also contemplated. For example, the articulating section 124*c* can be retracted substantially linearly (as opposed to pivoted beneath the articulating section 124*b*) within or beneath the articulating section 124*b* to form a chair configuration as disclosed below.

In the exemplary embodiment illustrated in FIGS. 9A-9F, two section actuators 142*a*, 142*b* are shown. A first section actuator 142*a* is coupled to the head section 124*a* and the seat section 142*b*, and a second section actuator 142*b* is coupled to the seat section 142*b* and the foot section 142*c*. The section actuators 142 are coupled to or in electronic communication with the controller 150, through wired means or wirelessly, as illustrated in FIG. 6. Upon a user input to the user input device 154, the controller 150 instructs the section actuators 142 to articulate the articulating sections 124*a*, 124*b*, 124*c* consistent with the disclosure below. In a preferred embodiment, the section actuators 142 are electric motors generating a rotational output in response to an electrical input. Any suitable gearing can be incorporated to produce the desired speed and torque properties of the electric motor. Alternatively or additionally, a mechanical actuator, hydraulic piston, pneumatic piston, electromagnetic solenoid, or other suitable actuator can be included in the section actuators 142 without deviating from the objects of the present disclosure.

Figure 9C:
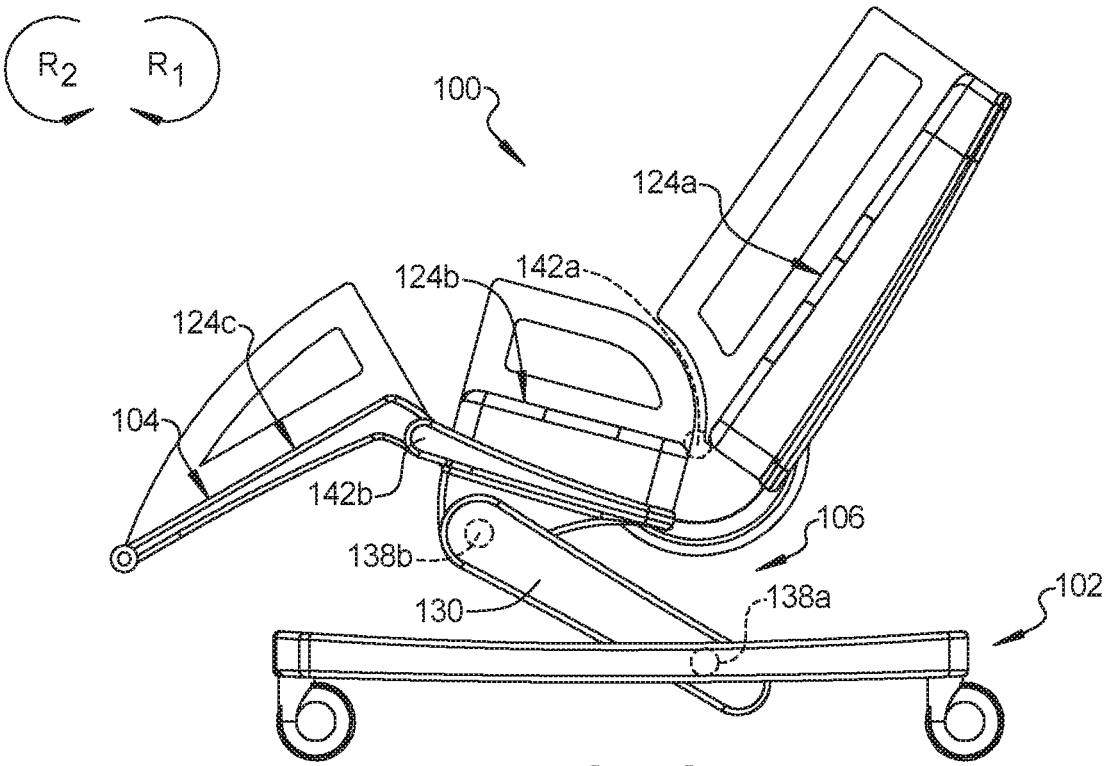
FIG. 9C is a side elevation view of the patient support apparatus of FIG. 9A with the patient support surface in a reclined position.

Referring to FIG. 9C, the patient support apparatus 100 is illustrated in a reclined configuration between the bed configuration and the chair configuration. The patient support surface 104 is neither generally horizontal nor planar. From the tilted position illustrated in FIG. 9B, the first section actuator 142*a* pivots the head section 124*a* relative to the seat section 124*b* in the second radial direction R2 to an angled orientation illustrated in FIG. 9C. The second section actuator 142*b* pivots the foot section 124*c* relative to the seat section 124*b* in the second radial direction R2. Those having skill in the art readily appreciate that the relative positioning of the articulating sections 124*a*, 124*b*, 124*c* illustrated in FIG. 9C is merely exemplary, and any number of configurations are possible.

Figure 9D:
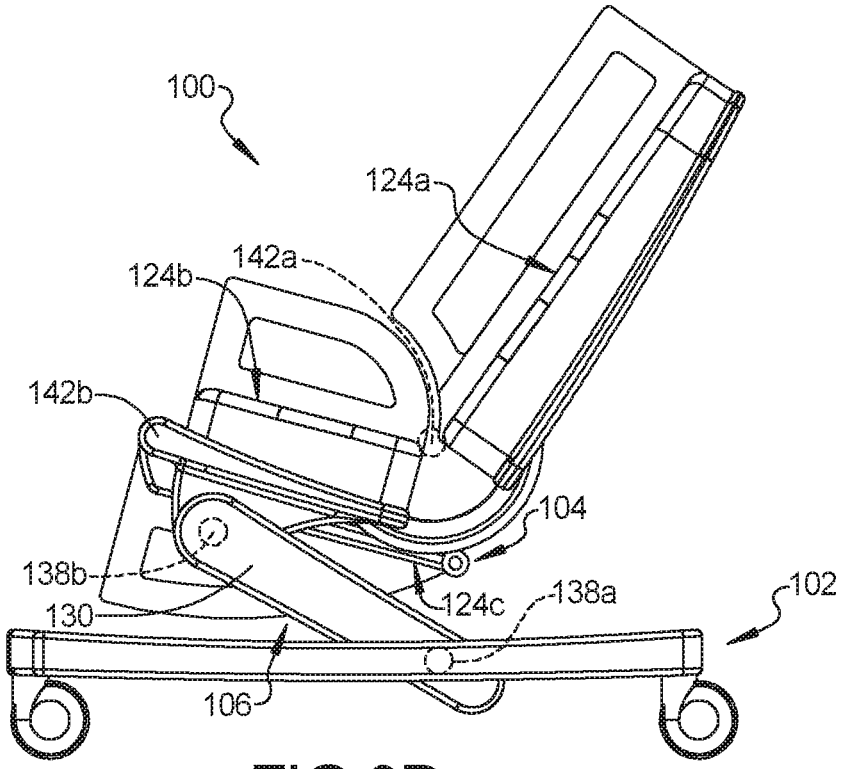
FIG. 9D is a side elevation view of the patient support apparatus of FIG. 9A with the patient support surface in a reclined position. A foot section of the patient support surface is shown in an articulated position oriented substantially parallel to a seat section.
Figure 9E:
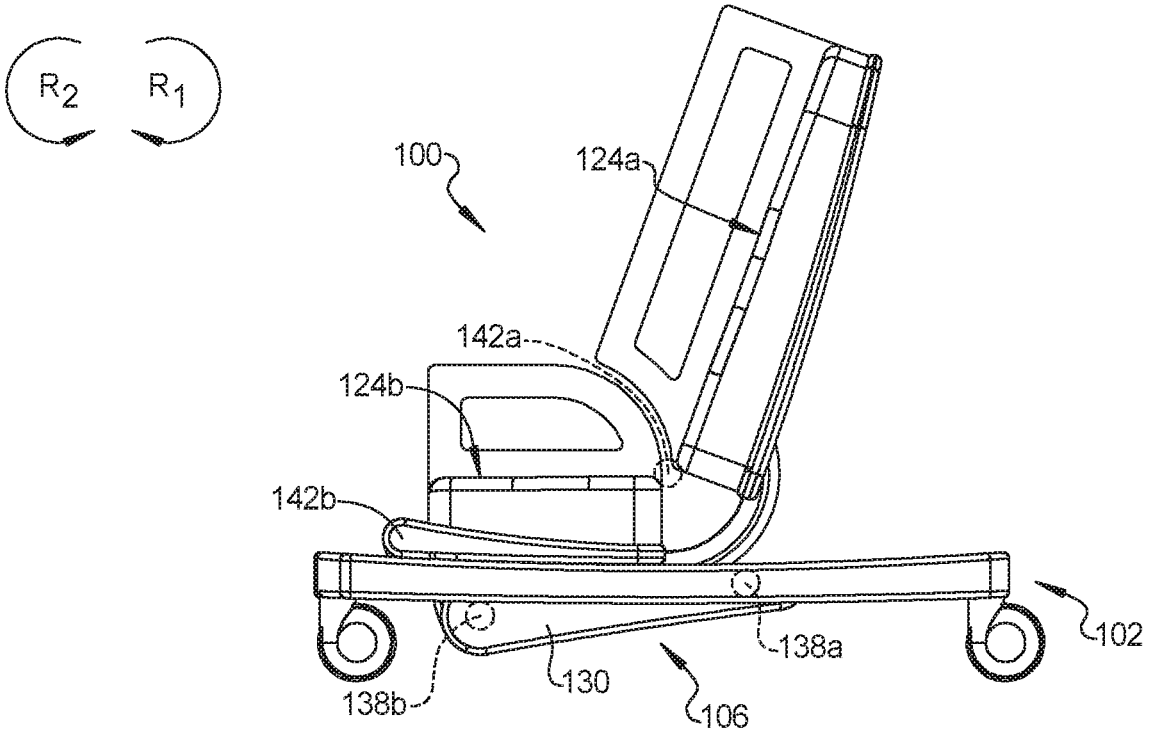
FIG. 9E is a side elevation view of the patient support apparatus of FIG. 9A with the patient support surface in a chair configuration.
Figure 9F:
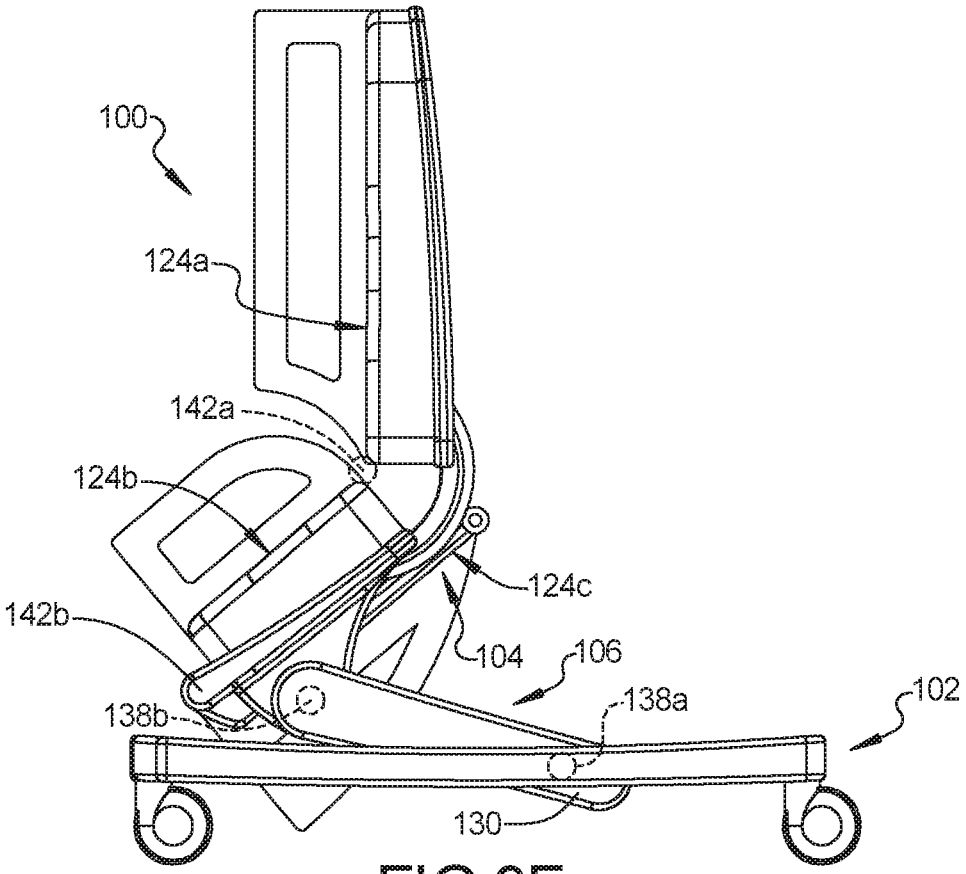
FIG. 9F is a side elevation view of the patient support apparatus of FIG. 9A with the patient support surface in a sit-to-stand position.

As previously disclosed herein, the lifting arms 130 can be generally positioned beneath the opposing sides 112 of the patient support surface 104 such that the lift device 106 of the patient support apparatus 100 provides considerable clearance to permit up to 180° articulation of the foot section 124*c* relative to the seat section 124*b*. FIGS. 9D-9F illustrate representative positions of the chair configuration. From the reclined configuration illustrated in FIG. 9C, the second section actuator 142*b* pivots the foot section 124*c* relative to the seat section 124*b* in the second radial direction R2 such that the foot section 124*c* passes through a vertical orientation and to a generally horizontal orientation substantially parallel to the seat section 124*b*. While up to 180° articulation of the foot section 124*c* is disclosed, the present disclosure contemplates lesser degrees of articulation provided the foot section 124*c* is disposed substantially beneath the seat section 124*b* in the chair configuration. The foot section 124*c* may articulate to a substantially vertical position as commonly known and practiced in the art.

In providing 180° articulation of the foot section 124*c*, the foot section 124*c* requires suitable clearance above the floor surface 12 in order to pass through the vertical orientation without interference from the floor surface 12. The controller 150 can instruct the actuator(s) 138 to increase the elevation of the patient support surface 104 and/or tilts the seat section 124*b* relative to horizontal to provide the necessary clearance. The controller 150 can do so either through user input or automatically. For example, if a user selects a predefined function (e.g., "chair configuration") on the user input device 154, the controller 150 detects the elevation and orientation of each of the articulating sections 124*a*, 124*b*, 124*c* and operates actuators 138 to provide the necessary clearance should such clearance not already be present.

The chair configuration is defined, in a most general sense, as including a substantially horizontal seat section 124*b* and an at least partially vertical back section 124*a*. Moving the patient support surface 104 between the bed configuration and the chair configuration can facilitate transitioning the patient from lying down to a seated state without undue burden on the patient and/or the caregiver.

Furthermore, the chair configurations illustrated in FIGS. 9E and 9F can facilitate transitioning the patient from the seated state to an ambulatory state. Whereas FIG. 9E illustrates the patient support surface 104 in a chair configuration with 180° articulation of the foot section 124*c*, FIG. 9F comprises the additional feature of sit-to-stand positioning. The sit-to-stand positioning comprises, among other things, pivoting the seat section 124*b* in the second radial direction R2 to tilt the seat section 124*b*. In so doing a patient is encouraged to transition from the seated state to an ambulatory state.

From the chair configuration illustrated in FIG. 9E, the seat section 124*b* can be pivoted relative to the lifting arm 130 in the second radial direction R2 by the second actuator 138*b*. Additionally, the first actuator 138*a* can also pivot the lifting arm 130 relative to the base 102 in the second radial direction R2 to change the elevation of the seat section 124*b* as it is concurrently tilted into the sit-to-stand positioning.

In each of the representative configurations illustrated in FIGS. 9A-9F, the first actuator 138*a* and the second actuator 138*b* can change the elevation of the patient support surface 104 relative to the base 102 while in a particular configuration. For example, the patient support surface 104 can be raised or lowered while in the intermediate configuration illustrated in FIG. 9C.

Figure 10:
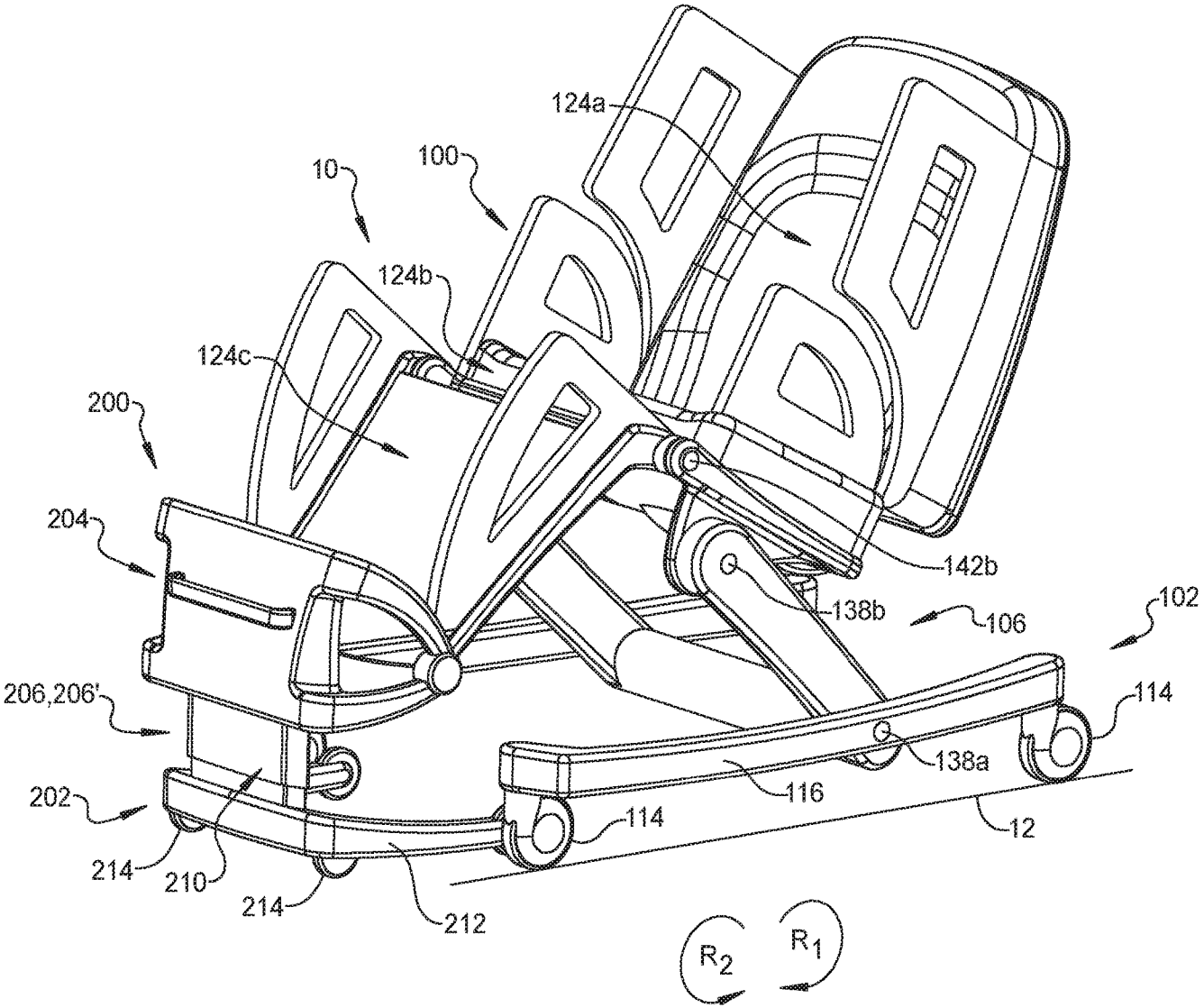
FIG. 10 is a perspective view of the patient mobility system of FIG. 1A, with the patient support apparatus and the ambulation device shown in a coupled configuration and the patient support surface of the patient support apparatus shown in a reclined position.
Figure 11:
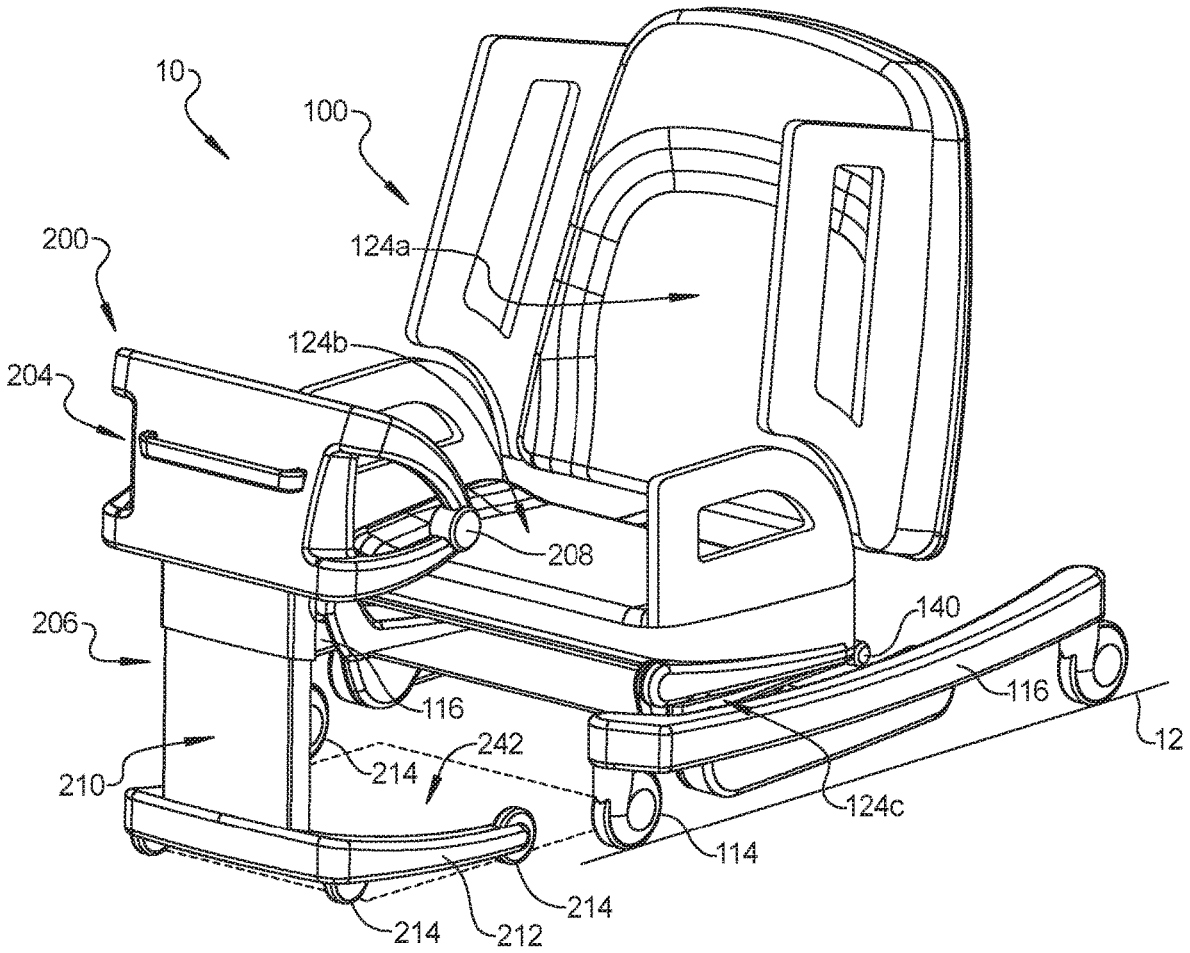
FIG. 11 is perspective view of the patient mobility system of FIG. 1A, with the patient support surface of the patient support surface in the chair configuration and the patient support apparatus and the ambulation device spaced apart from one another.

The configurations achievable with the articulating sections 124*a*, 124*b*, 124*c* can advantageously be used in conjunction with the ambulation device 200. The patient mobility system 10 in various configurations is illustrated in FIGS. 10 and 11. Referring first to FIG. 11, the patient support apparatus 100 and the ambulation device 200 are in the coupled configuration. Further, the patient support apparatus 100 is in the reclined configuration similar to the representative position illustrated in FIG. 9C (with the foot section 124*c* tilted to a greater degree).

The present disclosure advantageously provides articulating the articulating sections 124*a*, 124*b*, 124*c* while the patient support apparatus 100 and the ambulation device 200 are in the coupled configuration. Based on the coupling input signal, the controller 150 actuates the lock actuator 226, 234 to cause the linkage 227, 232 to move the locking element 224, 230 from the locked configuration to the unlocked configuration. In the unlocked configuration, of the gas spring 218 can compress or expand, and a change of elevation of the barrier 204 relative to the support frame 202 is permitted, as previously disclosed herein.

In response to the second section actuator 142*b* pivoting the foot section 124*c* relative to the seat section 124*b* in the second radial direction R2, the second lift device 206, 206' provides a corresponding movement or action in response. For example, pivoting the foot section 124*c* supplies a downward force to the gas spring 218 (FIG. 5) via the coupling members 140, 208. With the locking element 224 permitting compression the gas spring 218 in the unlocked configuration, the elevation of the barrier 204 relative to the support frame 202 is correspondingly changed. In another example, controller 150 transmits the output signal to the actuator 228 to change of elevation of the barrier 204 relative to the support frame 202 corresponding with the change in elevation of the patient support surface 104 relative to the base 102, particularly the elevation of the patient support surface 104 proximate the first coupling member 140. FIG. 10 illustrates that, in the coupled configuration and regardless of pivoting the articulating sections 124*a*, 124*b*, 124*c* (and/or changing the elevation of the patient support surface 104 relative to the base 102), the barrier 204 remains at a height above the patient support surface 104 sufficient to at least partially extend above the patient support surface 104 to prevent patient egress.

The coupling members 140, 208 in the coupled configuration can have one degree of freedom to permit rotation of the first coupling member 140 relative to the second coupling member 208 (i.e., a revolute joint). One having skill in the art can readily appreciate that an endpoint of a pivoting body has two-axis motion, e.g., a vertical component and a horizontal component. Thus, in the context of the embodiment illustrated in FIG. 10, pivoting the foot section 124*c* relative to the seat section 124*b* with the ambulation device 200 coupled to the foot section 124*c* requires the ambulation device 200 to translate horizontally in addition to changing the elevation of the barrier 204 relative to the support frame 202. The wheels 214 assist with the horizontal translation along the floor surface 12. The horizontal translation can be a result of pivoting the foot section 124*c* relative to the seat section 124*b* with the ambulation device 200 coupled to the foot section 124*c*, or a result of a user manually positioning the ambulation device 200 adjacent the patient support apparatus 100.

FIG. 10 illustrates a further advantage of the patient support apparatus 100 and the ambulation device 200. The feet 212 of the ambulation device 200 can be positioned beneath the patient support surface 104. The feet 212 extending away from the back 210 of the ambulation device 200 are spaced apart to a lesser extent than the elongated legs 116 of the base 102 of the patient support apparatus 100. Thus, in one configuration, the feet 212 are configured to overlap the elongated legs 116 when viewed in elevation, whether or not the patient support apparatus 100 and the ambulation device 200 are in the coupled configuration.

One such instance a user would desire to position the ambulation device 200 adjacent the patient support apparatus 100 to assist with a patient transfer, as illustrated in FIG. 11. The patient support apparatus 100 and the ambulation device 200 are not in the coupled configuration, and the patient support apparatus 100 is in the chair configuration similar to the representative position illustrated in FIG. 9E.

Should a patient be in a seated state on the patient support apparatus 100 in the chair configuration, the ambulation device 200 can be translated horizontally along the floor surface 12 to position the ambulation device 200 adjacent the patient support apparatus 100 to facilitate the patient transfer. The wheels 214 of the ambulation device 200 assist with this translation. As mentioned, the feet 212 of the ambulation device 200 can overlap the elongated legs 116 of the patient support apparatus 100 (when viewed in elevation) to permit the ambulation device 200 and the patient support apparatus 100 to be positioned as close as possible to accommodate the patient during the patient transfer. In such an arrangement, the back 210, the feet 212, the barrier 204, and/or the articulating sections 124*a*, 124*b*, 124*c* in the chair configuration cooperate to define a patient transfer space 242 configured to facilitate transitioning the patient from the seated state to an ambulatory state. More specifically, the patient transfer space 242 is defined by a downward projection of the back 210 and the feet 212 of the ambulation device 200, and the downward projection of an edge of the seat section 124*b* proximate to the ambulation device, as illustrated in FIG. 11. The patient walking area 242 is a generally rectangular shape. In other words, the patient walking area 242 is the rectangular projection of the greatest length and width dimension of the back 210, the feet 212, and the edge of the seat section 124*b*, collectively.

Once in the ambulatory state, the ambulation device 200 provides support to a patient during ambulation away from the patient support apparatus 100 (see FIG. 3B). After the patient wishes to no longer be ambulatory, he or she can use the ambulation device 200 to return to the patient support device 100, preferably in the chair configuration, and be seated with the support provided by the ambulation device 200. Once in the seated state, the actuators 138 and section actuators 142 can adjust the patient support surface 104 to an intermediate position, after which the ambulation device 200 can be coupled to the patient support apparatus 100. In the coupled configuration, the barrier 204 is at a height sufficient to at least partially extend above the patient support surface 104 to prevent patient egress. Provided the patient support apparatus 100 and the ambulation device 200 remain in the coupled configuration, the barrier 204 remains at the height sufficient to prevent patient egress, regardless of any further change in elevation of the patient support surface 104 relative to the base 102 and/or articulating of the articulating sections 124*a*, 124*b*, 124*c*, consistent with the objects and advantages of the present disclosure described herein.

Figure 12:
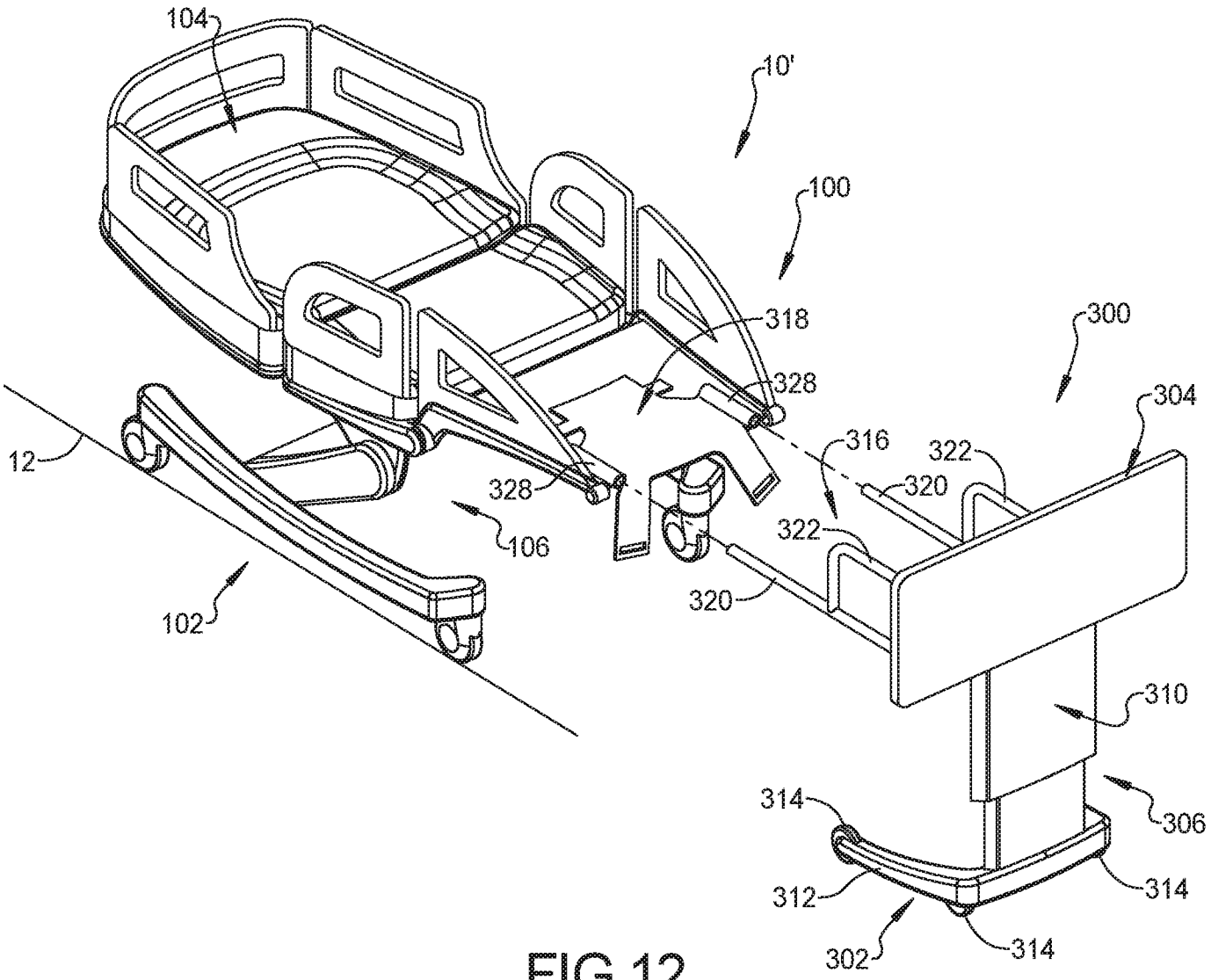
FIG. 12 is a perspective view of a second embodiment of a patent mobility system, with a third embodiment of the ambulation device shown having a patient carrier mount, in a deployed position.

A patient mobility system 10' for early patient ambulation in accordance with another exemplary embodiment of the present disclosure is illustrated in FIG. 12. The patient mobility system 10 comprises the patient support apparatus 100 comprising the base 102 and the patient support surface 104 supported by the base 104. The patient support surface 104 supports a patient above a floor surface 12. The first lift device 106 moves the patient support surface 104 relative to the base 102. The structure and function of the patient support apparatus 100 of FIG. 12 is substantially the same as the embodiment previously disclosed herein.

The patient mobility system 10' comprises an ambulation device 300. The ambulation device 300 comprises a support frame 302 and a barrier 304 coupled to the support frame 302. The support frame 302 can further comprise feet 312 extending away from a back 310, and wheels 314 are configured to facilitate transport of the ambulation device 300 over the floor surface 12. The ambulation device 300 is configured to be removably coupled to the patient support apparatus 100, and in the coupled configuration, the barrier 304 prevents patient egress by being adjacent to the patient support surface 104 and by having a height sufficient to at least partially extend above the patient support surface 104 of the patient support apparatus 100. The ambulation device 300 may include any of the features described above with respect to ambulation device 200 described above.

To couple to the ambulation device 300 to the patient support apparatus 100, the ambulation device 300 comprises a second coupling member 308 (see FIG. 14A) similar in many respects to the second coupling member 208 previously disclosed herein. The second coupling member 308 can removably couple to the first coupling member 140 associated with the patient support apparatus. In the exemplary embodiment illustrated in FIG. 12-14B, the second coupling member 308 is coupled the barrier 304. Other suitable locations for the second coupling member 308 are contemplated, including the support frame 302, the patient carrier mount 316, and the like.

The ambulation device 300 further comprises a second lift device 306 to move the barrier 304 relative to the support frame 302. In the coupled configuration, each of the patient support apparatus 100 and the ambulation device 300 operates consistent with the present disclosure previously discussed herein.

The ambulation device 300 further comprises a patent carrier mount 316 coupled to the barrier 304 and/or the support frame 302 and configured to support a patient above the floor surface 12. In the illustrated embodiment, the patient carrier mount 316 comprises arms 320 extending away from the barrier 304. However, other configurations are contemplated. Handles 322 can be coupled to the arms 320 to provide support with patient ambulation away from the patient support apparatus 100. The present disclosure also contemplates the handles 322 can be coupled to the barrier 304 and/or the support frame 302. Alternatively or additionally, the handles 322 can comprise a portion of the arms 320. In other aspects of the present disclosure, no discrete handles are provided. The handles 322, the arms 320, the barrier 304, and/or other suitable structure of the ambulation device 300 can comprise a grip to provide support to the patient during ambulation consistent with the present disclosure previously discussed herein.

Figure 13A:
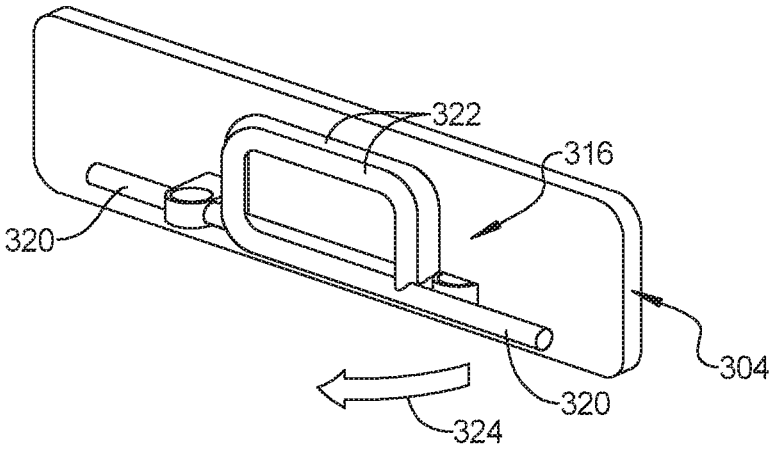
FIG. 13A is a perspective cut-away view of the third embodiment of the ambulation device of FIG. 12, with the patient carrier mount in a folded configuration.
Figure 13B:
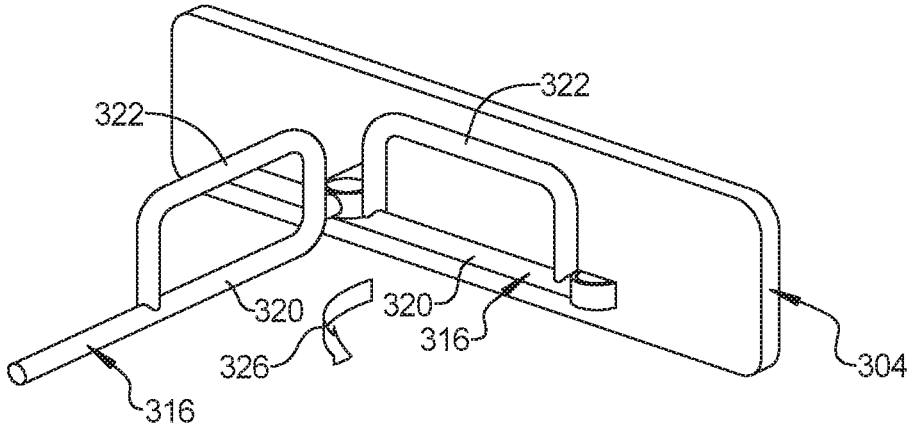
FIG. 13B is a perspective cut-away view of the third embodiment of the ambulation device of FIG. 12, with the patient carrier mount shown in a partially deployed configuration.
Figure 13C:
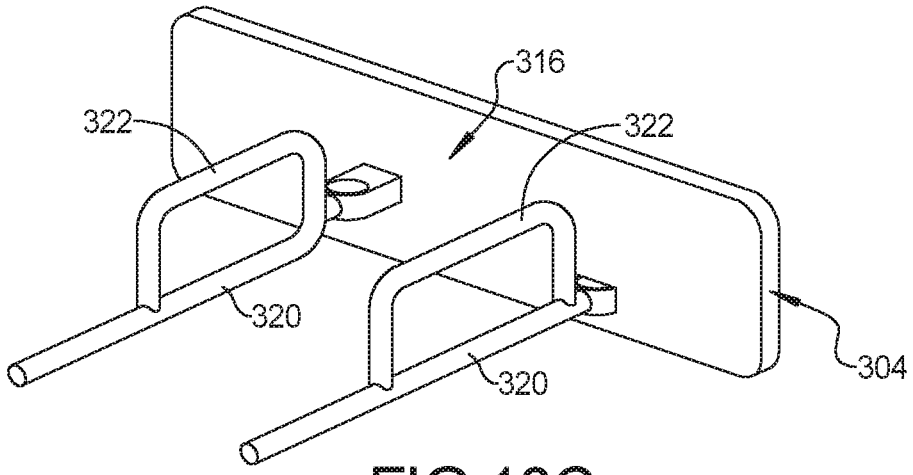
FIG. 13C is a perspective cut-away view of the third embodiment of the ambulation device of FIG. 12, with the patient carrier mount shown in the deployed configuration.

The arms 320 can be configured to deploy from the barrier 304 to a deployed configuration. To do so, the arms 320 can be pivotally mounted to the barrier 304. FIGS. 13A-13C show the arms 320 of the patient carrier mount 316 at various stages of deployment. In FIG. 13A, the arms 320 are in a non-deployed or stowed position. More particularly, the arms 320 are oriented substantially parallel to the barrier 304. The elevation of one of the arms 320 can be above the other one of the arms 320 such that the arms 320, when pivoted inwardly as illustrated, do not contact one another before each arm 320 is oriented substantially parallel to the barrier 304. Similarly, the pivot joint of one of the arms 320 can be positioned away from the barrier 304 such that the arms 320, when pivoted inwardly as illustrated, do not contact one another before each arm 320 is oriented substantially parallel to the barrier 304.

To move the arms 320 to the deployed configuration, one of the arms 320 is pivoted relative to the barrier 304 in the direction of arrow 324. FIG. 13B illustrates the patient carrier mount 316 with one arm 320 in the deployed configuration. The other arm 320 is pivoted relative to the barrier 304 in the direction of arrow 326. FIG. 13C illustrates the patient carrier mount 316 with both arms 320 in the deployed configuration. In the exemplary embodiment illustrated in FIGS. 13A-13C, the arm 320 is pivoted until the arm 320 is substantially perpendicular to the barrier 304. However, the arms 320 can be oriented at any angle relative to the barrier 304 without deviating from the objects of the present disclosure. Further, the present disclosure contemplates any means for providing a terminus to stop further pivoting of the arms 320 relative to the barrier 304 as commonly known in the art.

Figure 14A:
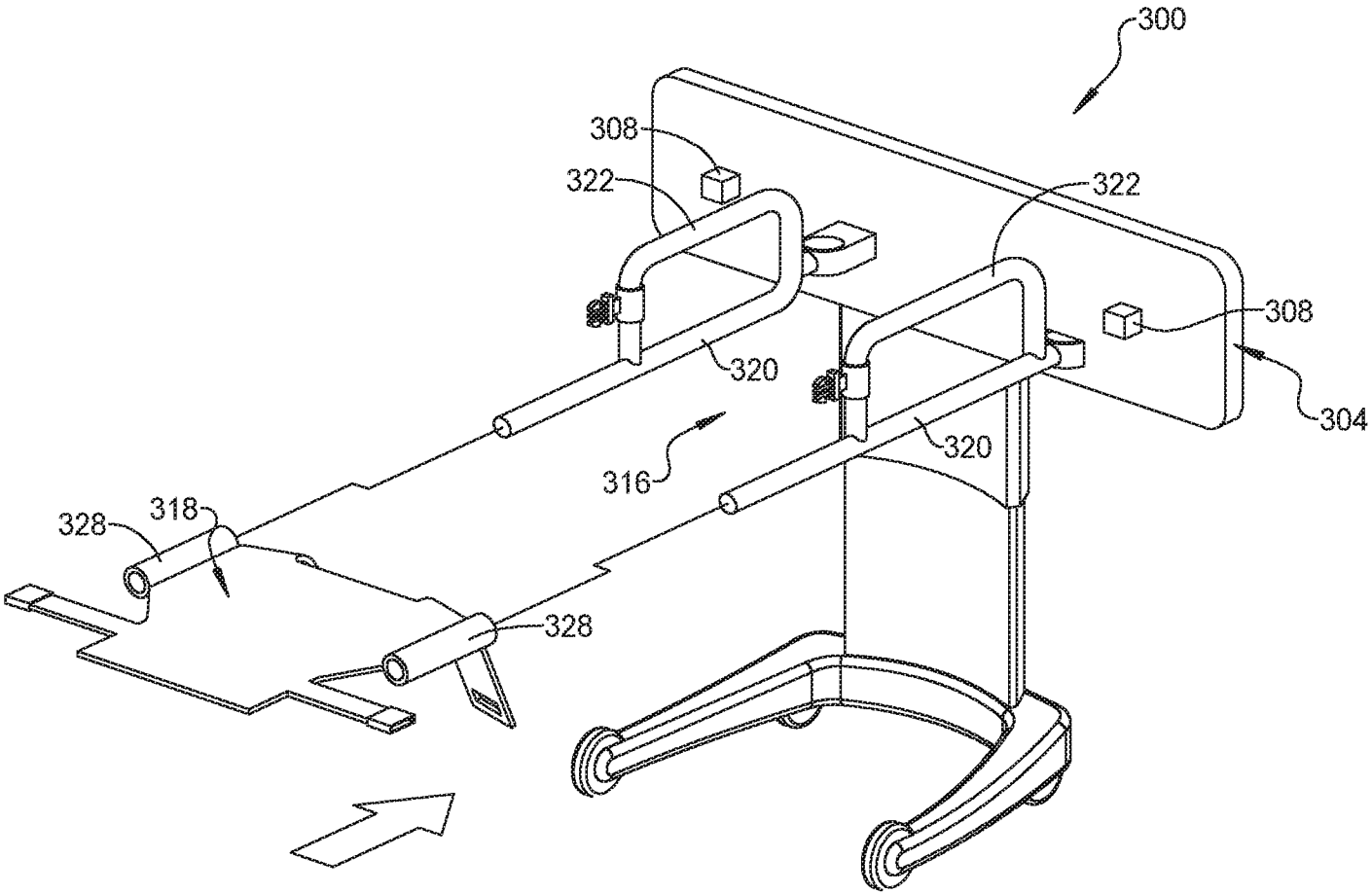
FIG. 14A is a perspective view of the third embodiment of the ambulation device of FIG. 12 with the patient carrier mount shown in the deployed configuration, and a patient carrier spaced apart from the patient carrier mount.
Figure 14B:
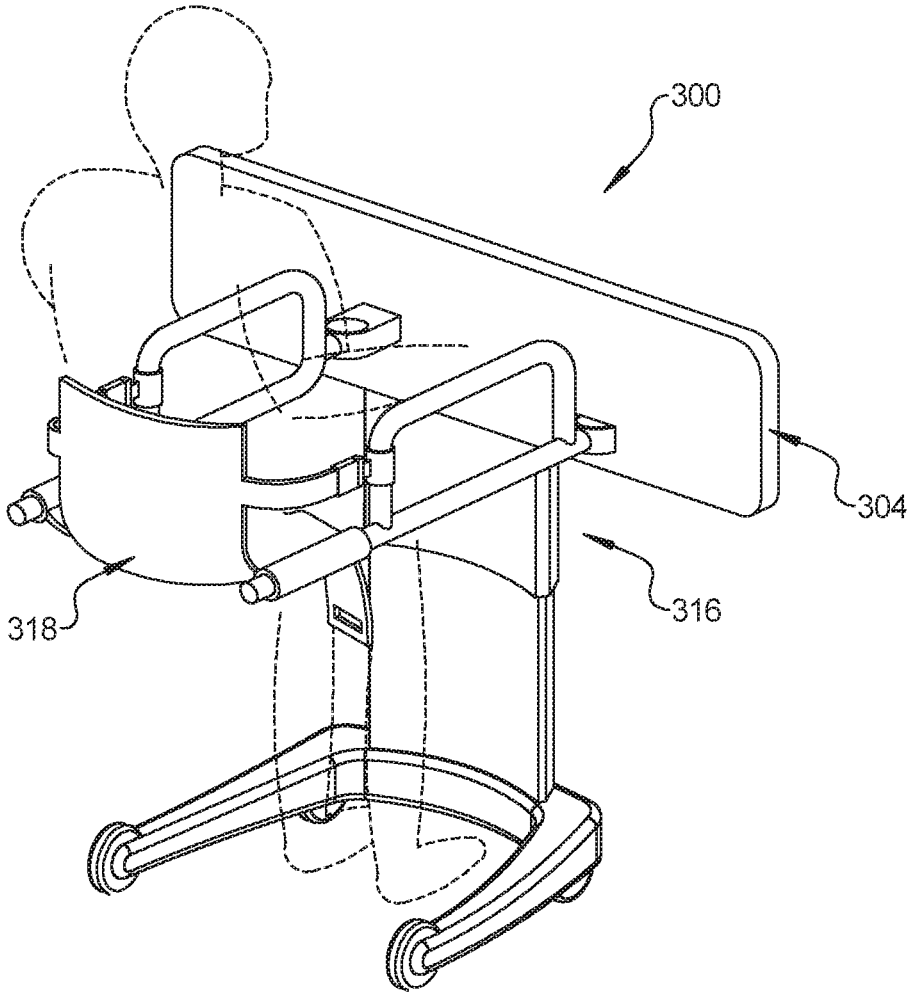
FIG. 14B is a perspective view of the third embodiment of the ambulation device of FIG. 12, with the patient carrier coupled to the patient carrier mount and supporting a patient in a seated position.

Referring to FIGS. 14A and 14B, the patient mobility system 10' further comprises a patient carrier 318. The patient carrier 318 removably couples with the patient carrier mount 316. The patient carrier 318 comprises mounting portions 328. The arms 320 are configured to engage the mounting portions 328 when the arms 320 are in the deployed configuration. The arms 320 can comprise an elongated portion that couples to the mounting portion 328 having a tubular shape.

In at least some aspects of the present disclosure, the patient carrier 318 is a sling removably coupled to the patient carrier mount 318. The sling can be constructed of a suitable material configured to conform to the patient while supporting the weight of the same. The patient carrier 318, and more particularly the sling, is configured to cooperate with the barrier 304 to support the patient in a seated position. One exemplary ambulation device comprising a patient carrier is disclosed in U.S. Patent Publication No. 20170056267, filed on Feb. 13, 2015, which is herein incorporated by reference in its entirety.

In the deployed configuration and coupled to the patient carrier 318, the arms 320 are configured to support the patient when the ambulation device 300 is not coupled to the patient support apparatus 100. Thus, the patient is seated upon the patient carrier 318 and the ambulation device 300 can transport the patient above the floor surface 12, as illustrated in FIG. 14B.

In at least one hypothetical scenario, such as in the early stages of illness or injury, the patient might be "bed bound," during which the ambulation device 300 is coupled to the patient support apparatus 100 and prevents patient egress. After the patient is believed to have functional improvement, ambulation device 300 can be uncoupled and support and transport the above the patient above the floor surface 12 in the patient carrier 320. This provides some early mobility without requiring weight bearing by the patient. In another example, the patient is almost entirely supported above the floor surface 12 in the patient carrier 320, but his or her feet are in contact with the floor surface 12, as illustrated in FIG. 14B. The arrangement advantageously permits the patient to "scoot" using his or her feet along the floor surface 12 in the ambulation device 300 with minimal resistance due to the wheels, further promoting early mobility.

After the patient is believed to have further functional improvement, the patient carrier 318 can be removed from (or not coupled to) the patient carrier mount 316, after which the arms 320 (and/or the handles 322) can support the patient during ambulation away from the patient support apparatus 100 to promote further early and more demanding mobility. Variations of the hypothetical patient trajectory apply to other embodiments of the present disclosure discussed herein. Thus, throughout the various stages of illness or injury, the ambulation device advantageously remains a functional component of the patent mobility system, regardless of whether the patient is "bed bound," non-weight bearing status, or partially weight bearing status.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient mobility system for early patient ambulation, said patient mobility system comprising:

a patient support apparatus comprising:

a base, a patient support surface supported by said base, and a first lift device to move said patient support surface relative to said base, and an ambulation device configured to provide support to a patient during ambulation away from said patient support apparatus, said ambulation device comprising:

a support frame, a barrier coupled to said support frame, and a second lift device to move said barrier relative to said support frame, wherein said ambulation device is configured to be removably coupled to said patient support apparatus, such that in a coupled configuration, said barrier prevents patient egress from said patient support apparatus by being positioned adjacent to said patient support surface and by having a height sufficient to at least partially extend above said patient support surface; and wherein said second lift device is further configured to be retractable such that said patient support apparatus supports said ambulation device off of a floor surface when said patient mobility system is in said coupled configuration.

2. The patient mobility system of claim 1, further comprising a controller configured to:

determine a state of said first lift device and said second lift device, and transmit an output signal to at least one of said first lift device and said second lift device in response to a change in state of one of said first lift device and said second lift device to maintain relative positioning of said patient support surface and said barrier in said coupled configuration.

3. The patient mobility system of claim 2, wherein said controller is in wireless communication with at least one of said first lift device and said second lift device.

4. The patient mobility system of claim 1, wherein:

said patient support apparatus further comprises a first coupling member coupled to one of said base, said patient support surface, and said first lift device, said ambulation device further comprises a second coupling member coupled to one of said second lift device, said barrier, and said support frame, and said coupled configuration is defined by engagement of said first coupling member with said second coupling member.

5. The patient mobility system of claim 4, further comprising:

a controller, a sensor operably coupled to one of said first coupling member and said second coupling member, said sensor configured to determine whether said first coupling member is engaged with said second coupling member and to provide a coupling input signal to said controller, said controller configured to transmit an output signal to at least one of said first lift device and said second lift device based on said coupling input signal.

6. The patient mobility system of claim 4, wherein said patient support apparatus further comprises a head end opposite a foot end, wherein said first coupling member is positioned adjacent to one of said head end and said foot end such that, when said second coupling member is engaged with said first coupling member, said barrier is positioned adjacent to said one of said head end and said foot end to form said barrier to prevent patient egress from said one of said head end and said foot end.

7. The patient mobility system of claim 5, wherein said second lift device comprises a gas spring, wherein said gas spring further comprises:

a movable element and a housing, said movable element operable to move relative to said housing to change an elevation of said barrier relative to said support frame, and a locking element operable in a locked configuration and an unlocked configuration, wherein, when said locking element is in said locked configuration, said locking element prevents movement of said movable element relative to said housing to maintain said elevation of said barrier relative to said support frame, and wherein, when said locking element is in said unlocked configuration, said locking element permits movement of said movable element relative to said housing to change said elevation of said barrier relative to said support frame.

8. The patient mobility system of claim 5, wherein said controller is further configured to transmit said output signal to said second lift device to cause retraction of said second lift device when said coupling input signal indicates that said ambulation device and said patient support apparatus are in said coupled configuration to lift said support frame of said ambulation device off of the floor surface.

9. The patient mobility system of claim 7, wherein said ambulation device further comprises:

a linkage and a lock actuator, said linkage operably coupled to said locking element, and said lock actuator operably coupled to said linkage and in communication with said controller, wherein said controller is configured to actuate said lock actuator to cause said linkage to move said locking element between said locked configuration and said unlocked configuration based on said coupling input signal.

10. The patient mobility system of claim 9, wherein said controller is further configured to actuate said lock actuator to cause said linkage to move said locking element from said unlocked configuration to said locked configuration when said coupling input signal indicates that said ambulation device and said patient support apparatus are not in said coupled configuration, and/or actuate said lock actuator to cause said linkage to move said locking element from said locked configuration to said unlocked configuration when said coupling input signal indicates that said ambulation device and said patient support apparatus are in said coupled configuration.

11. The patient mobility system of claim 1, wherein said support frame further comprises a back and feet extending away from said back, said back and said feet cooperate to define a patient walking area therebetween.

12. The patient mobility system of claim 11, wherein said support frame comprises wheels coupled to said feet.

13. The patient mobility system of claim 11, wherein said patient support apparatus comprises articulating sections configured to articulate said patient support surface between a bed configuration and a chair configuration, wherein said back, said feet, said barrier, and said articulating sections in said chair configuration cooperate to define a patient transfer space configured to facilitate transitioning the patient from a seated state to an ambulatory state.

14. The patient mobility system of claim 1, wherein said ambulation device further comprises an accessory support coupled to one of said second lift device, said barrier, and said support frame.

15. The patient mobility system of claim 1, wherein said ambulation device further comprises a patient carrier mount coupled to one of said barrier and said support frame and configured to support a patient above the floor surface.

16. The patient mobility system of claim 15, further comprising a patient carrier, said patient carrier comprising a sling removably coupled to said patient carrier mount with said sling configured to cooperate with said barrier to support the patient in a seated position.

17. The patient mobility system of claim 16, wherein said patient carrier mount comprises arms configured to deploy from said barrier to a deployed configuration, and when said arms are in said deployed configuration, said patient carrier mount arranged to bear said patient carrier.

18. The patient mobility system of claim 17, further comprising a patient carrier comprising mounting portions, said arms are configured to engage said mounting portions when said arms are in said deployed configuration.

19. The patient mobility system of claim 18, wherein said arms and said patient carrier are configured to lift said patient when in said deployed configuration and when said ambulation device is not coupled to said patient support apparatus.

20. The patient mobility system of claim 1, further comprising:

a first coupling member coupled to said patient support apparatus at a position above said base such that said first coupling member is configured to move relative to said base; and a second coupling member coupled to said ambulation device, wherein said coupled configuration is defined by engagement of said first coupling member with said second coupling member.

* * * * *